US009244394B2

(12) United States Patent
Fukushi

(10) Patent No.: US 9,244,394 B2
(45) Date of Patent: Jan. 26, 2016

(54) FIXING APPARATUS AND IMAGE FORMING APPARATUS

(71) Applicant: CANON KABUSHIKI KAISHA, Tokyo (JP)

(72) Inventor: Kenji Fukushi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/249,236

(22) Filed: Apr. 9, 2014

(65) Prior Publication Data

US 2014/0314454 A1 Oct. 23, 2014

(30) Foreign Application Priority Data

Apr. 17, 2013 (JP) ..... 2013-086374

(51) Int. Cl.
*G03G 15/20* (2006.01)
*G03G 15/00* (2006.01)

(52) U.S. Cl.
CPC ..... *G03G 15/2028* (2013.01); *G03G 15/55* (2013.01)

(58) Field of Classification Search
CPC ..... G03G 15/6532; G03G 15/2085; G03G 2215/00751; G03G 2215/00738; G03G 2215/00742; G03G 15/2028
USPC ..... 399/323
See application file for complete search history.

(56) References Cited

U.S. PATENT DOCUMENTS

2003/0039491 A1* 2/2003 Bogoshian ..... 399/323

FOREIGN PATENT DOCUMENTS

JP 2004-212954 A 7/2004
JP 2009-271345 A 11/2009

* cited by examiner

*Primary Examiner* — David Bolduc
*Assistant Examiner* — Barnabas Fekete
(74) *Attorney, Agent, or Firm* — Canon U.S.A., Inc. IP Division

(57) ABSTRACT

A fixing unit includes a current detection portion configured to detect a drive current of a pump unit and determines whether a valve unit is in an abnormal state corresponding to the output of the current detection portion.

16 Claims, 26 Drawing Sheets

FIXING APPARATUS AND IMAGE FORMING APPARATUS

BACKGROUND OF THE INVENTION

1. Field of the Invention

The present invention relates to a fixing apparatus configured to fix a toner image onto a sheet and an image forming apparatus including the fixing unit.

2. Description of the Related Art

Image forming apparatuses configured to form an image using an electrophotographic method includes a fixing unit configured to fix a toner image onto a surface of a recording material (referred to as sheet or paper) by a transfer method or a direct method. When the fixing unit fixes the toner image, paper with the unfixed toner image is guided to pass through a nip portion formed by a pair of rollers (i.e., a heating roller with a heated surface and a pressure roller). While the paper passes through the nip portion, heat and pressure is applied to the sheet. Accordingly, the unfixed toner is fused and fixed to the surface of the paper.

Since the unfixed toner on the paper is fused when the paper passes through the nip portion, there has been a possibility that a jam is caused by the paper wrapping around the heating roller due to the viscous behavior of the toner. Conventionally, in order to avoid such a paper jam, the fixing unit, such as the one described above, uses a separation claw which contacts the heating roller to separate the paper wrapping around the heating roller.

The separation claw can easily separate the paper from the heating roller if the image density is low or if enough space is provided between the leading edge of the paper and the top of the image (hereinafter referred to as a margin). Meanwhile, for example, if paper of a small grammage (especially coated paper) is used or the toner image is a color image of increased density or, further, the margin of the paper is small, the paper tends to wrap around the heating roller. Thus, in such a case, the separation claw may not be able to appropriately separate the paper from the heating roller.

Further, since the separation claw contacts the heating roller, the claw may scratch the surface of the heating roller. In such a case, the scratch may be transferred to the fused toner and a defective image may be formed.

Under such circumstances, a separation method that does not form a scratch on the heating roller is discussed in Japanese Patent Application Laid-Open No. 2004-212954 and No. 2009-271345. According to the separation method, compressed air is jetted from a nozzle toward the heating roller to separate the paper from the heating roller. Further, according to the method discussed in Japanese Patent Application Laid-Open No. 2004-212954, air compressed by a pump is jetted from a solenoid valve in pulses to separate the paper.

However, as discussed in Japanese Patent Application Laid-Open No. 2004-212954 and No. 2009-271345, since the air compressed by a pump is blown out from a nozzle, if the solenoid valve fails due to, for example, its deterioration, it may result in a paper jam at the fixing unit. If the paper jam occurs due to a failed solenoid valve, processing for solving the jam takes time, which results in the downtime of the image forming operation. Thus, it is convenient if the failure of the solenoid valve can be detected in advance.

SUMMARY OF THE INVENTION

According to an aspect of the present invention, a fixing apparatus including a first rotating member and a second rotating member configured to form a nip portion used for fixing a toner image onto a sheet, an air blowing portion configured to blow air to separate the sheet from the first rotating member, a pump unit connected to the air blowing portion, a valve unit configured to supply or not supply air compressed by the pump unit to the air blowing portion, a current detection portion configured to detect a drive current of the pump unit when the air is compressed, and a determination unit configured to determine whether abnormality of the valve unit exists corresponding to an output of the current detection portion.

According to another aspect of the present invention, an image forming apparatus includes an image forming unit configured to form a toner image on a sheet, a first rotating member and a second rotating member configured to form a nip portion used for fixing a toner image onto a sheet, an air blowing portion configured to blow air for separating a sheet of a grammage equal to or less than a predetermined value from the first rotating member, a pump unit connected to the air blowing portion, a valve unit configured to supply or not supply air compressed by the pump unit to the air blowing portion, and a control unit configured to control the image forming apparatus such that if the valve unit is abnormal, image forming of a sheet of the grammage equal to or less than the predetermined grammage is inhibited and image forming of a sheet of a grammage greater than the predetermined grammage is permitted.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

(Image Forming Apparatus)

Figure 1:
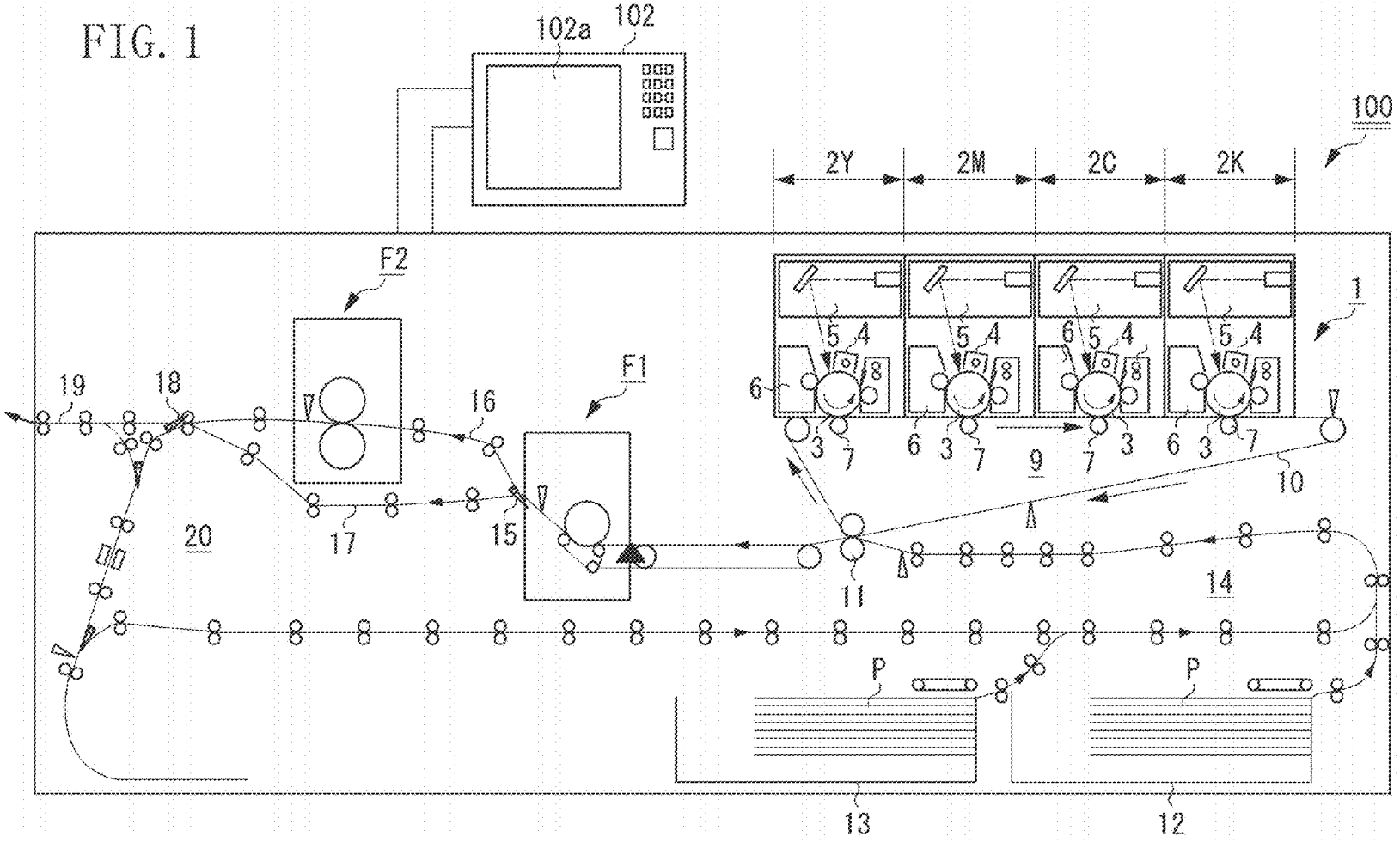
FIG. 1 illustrates a configuration of an image forming apparatus according to a first exemplary embodiment of the present invention.

A first exemplary embodiment of the present invention will be described. FIG. 1 illustrates a configuration of an image forming apparatus 100 configured to form an image corresponding to image information input from a host apparatus (not illustrated) on a recording material by using an electrophotographic recording technique. According to the present embodiment, the image forming apparatus 100 is a full-color printer. The recording material is a sheet member where a toner image can be formed. Various types of paper such as plain paper, resin coated paper, an overhead projector (OHP) sheet, an envelope, or a postcard of a standard or a non-standard size can be used as the recording material, which is hereinafter referred to as a sheet or paper.

An image forming unit 1 includes four image forming stations 2Y, 2M, 2C, and 2K configured to form an image on paper P (sheet) fed from a paper cassette 12 or 13 and conveyed by a conveyance mechanism 14. Each station includes a photosensitive member 3 of a rotation drum type, a charging member 4, a laser scanner 5, a developer 6, a transfer member 7, and a photosensitive member cleaner 8. The image forming stations 2Y, 2M, 2C, and 2K form toner images of yellow, magenta, cyan, and black, respectively.

The image forming unit 1 further includes an intermediate transfer belt unit 9 and secondary-transfers a toner image, which has been primary-transferred onto an intermediate transfer belt 10 by the image forming stations 2Y, 2M, 2C, and 2K, onto the paper P by a secondary transfer roller 11. Since the operation of the image forming unit 1 is based on a known technique, detailed descriptions of the operation is not provided.

The paper P having the unfixed toner image transferred by the image forming unit 1 is conveyed to a first fixing unit (first fixing apparatus) F1. At the first fixing unit F1, the toner image is heated and fixed to the paper P. The paper P conveyed from the first fixing unit F1 is further conveyed to either a first path 16 or a second path 17. The conveying path is switched by a flapper 15 according to a mode selected in advance.

The paper P conveyed to the first path 16 is further conveyed to a second fixing unit (second fixing apparatus) F2. The second fixing unit F2 is used for applying gloss to the toner image on the paper P fixed by the first fixing unit F1 or ensuring the fixing of the toner image on the paper P. Depending on the paper type of the paper P, the second fixing unit F2 is not always necessary. If the second fixing unit F2 is not necessary, the paper P that passed through the first fixing unit F1 is conveyed to the second path 17 without the second fixing unit F2 for energy reduction.

If the image forming apparatus 100 is in a one-sided image forming mode, the paper P that passed through the first path 16 or the second path 17 is discharged from the image forming apparatus 100 after it is conveyed through a conveying path 19. If the image forming apparatus 100 is in a two-sided image forming mode, the path of the paper P with the one-sided image that passed through the first path 16 or the second path 17 is switched, by a flapper 18, to the side of a recirculation conveyance mechanism 20 including a switchback unit. Then, the paper P is conveyed again in a reversed state to the image forming unit 1 via the conveyance mechanism 14. An operation panel unit 102 is an operation unit of the image forming apparatus 100. An information display unit 102*a* of the operation panel unit 102 is, for example, a liquid crystal display unit.

(Fixing Unit)

Figure 2:
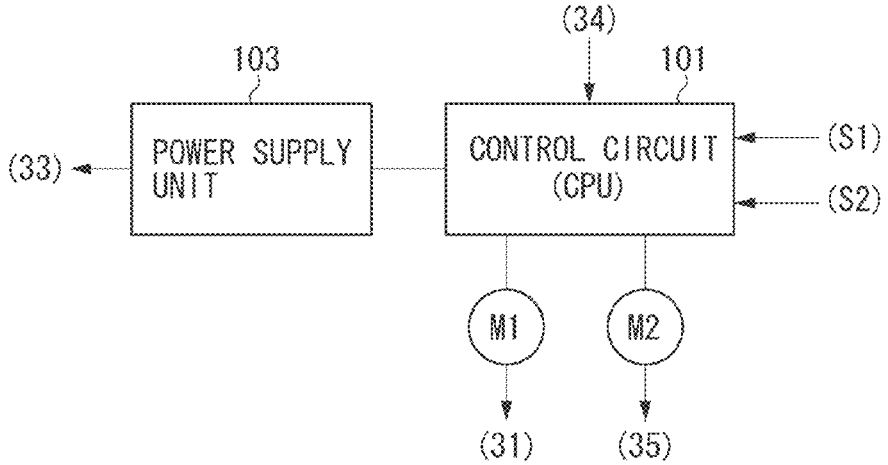
FIG. 2 is a block diagram illustrating an enlarged view of a main part of a first fixing unit and a control system.
Figure 2:
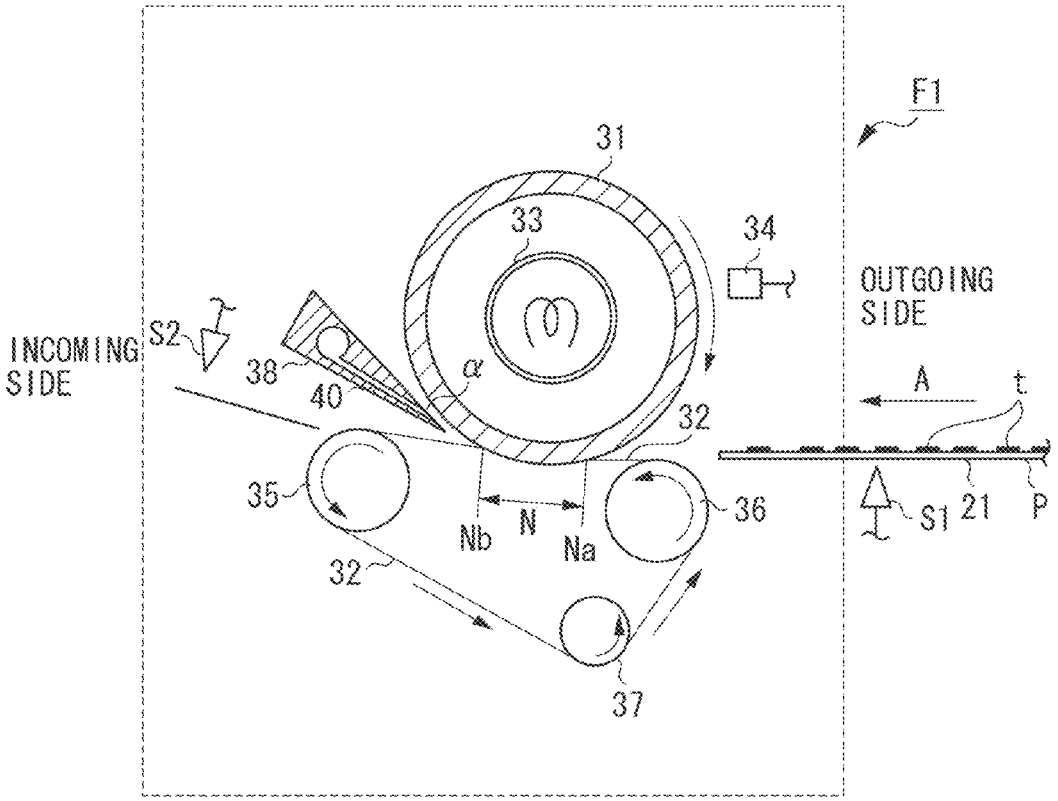

FIG. 2 is an enlarged view of a main portion of the first fixing unit F1 and a block diagram of the control system. The first fixing unit F1 includes a first rotating member (i.e., a heating roller 31) and a second rotating member (i.e., a pressure application belt 32) which form a nip portion N where the toner image is fixed to the paper P. The heating roller 31 fixes the toner image while the image carrying paper is conveyed through the nip portion N. The pressure application belt 32 forms the nip portion N with the heating roller 31.

The heating roller 31 is a hollow roller with a stiffness of a metal such as aluminum. A mold release layer of, for example, fluorine resin is formed on its outer periphery. An elastic layer can be formed on the inner side of the mold release layer. The heating roller 31 is rotatably held at both ends by bearings of an apparatus enclosure (not illustrated). A motor M1, which is controlled by a control circuit unit, rotates the heating roller 31 at a predetermined circumferential velocity in the clockwise direction indicated by an arrow. The control circuit unit (control unit) is hereinafter referred to as a CPU 101.

A heater 33 configured to apply heat to the heating roller 31 is provided inside the heating roller 31. The heater 33 is, for example, a halogen lamp. On receiving power from a power supply unit 103 according to the control of the CPU 101, the heater 33 generates heat and applies the generated heat to the heating roller 31 from the inside. The surface temperature of the heating roller 31 is detected by a thermistor 34 as a temperature detector, and the detected temperature information is input in the CPU 101. According to the control of the CPU 101, the surface temperature (fixing temperature) of the heating roller 31 is maintained at a predetermined level. The CPU 101 controls the power supplied from the power supply unit 103 to the heater 33 so that the temperature information obtained from the thermistor 34 corresponds to the predetermined fixing temperature.

The pressure application belt 32 is a heat resistant endless belt. The pressure application belt 32 is flexible and is stretched and supported by a first roller 35, a second roller 36, and a third roller 37. Since the belt portion between the first roller 35 and the second roller 36 contacts the heating roller 31, the long nip portion N of a predetermined width in a paper conveying direction A is formed between the heating roller 31 and the pressure application belt 32. The first roller 35 rotates in the counter clockwise direction indicated by an arrow at a circumferential velocity corresponding to the rotation circumferential velocity of the heating roller 31. The first roller 35 is rotated by a drive of a motor M2 controlled by the CPU 101.

The paper P carrying an unfixed toner image t, which has been conveyed from the image forming unit 1, is conveyed to the nip portion N of the first fixing unit F1 from a paper incoming side (recording material incoming side) Na. While the paper P passes through the nip portion N, the heating roller 31 applies heat and pressure to the paper P. Accordingly, the unfixed toner image t is fused and fixed to the paper P as a fixed image.

Further, in the vicinity of the heating roller 31 on a paper outgoing side (recording material outgoing side) Nb of the nip portion N, there is provided a separation guide plate 38 of the paper P used for separating the paper P from the heating roller 31. The separation guide plate 38 is provided in a contactless manner. In other words, a predetermined gap exists between the heating roller 31 and the separation guide plate 38. The separation guide plate 38 includes a nozzle mechanism 40 which blows compressed air to a gap a formed between the separation guide plate 38 and the heating roller 31. The nozzle mechanism 40 is an air blowing portion which blows air toward the heating roller 31 to separate the paper P from the heating roller 31. The nozzle mechanism 40 will be described below.

A sensor S1 is a transmission type paper detection sensor provided on a paper conveying path 21 on the paper incoming side of the first fixing unit F1. A sensor S2 is a transmission type paper detection sensor on the paper outgoing side of the first fixing unit F1.

Figure 3:
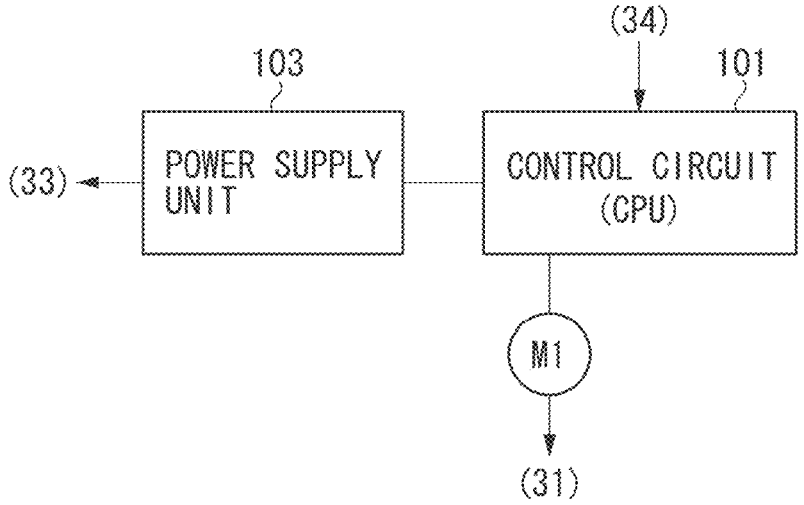
FIG. 3 is a block diagram illustrating an enlarged view of a main part of a second fixing unit and a control system.
Figure 3:
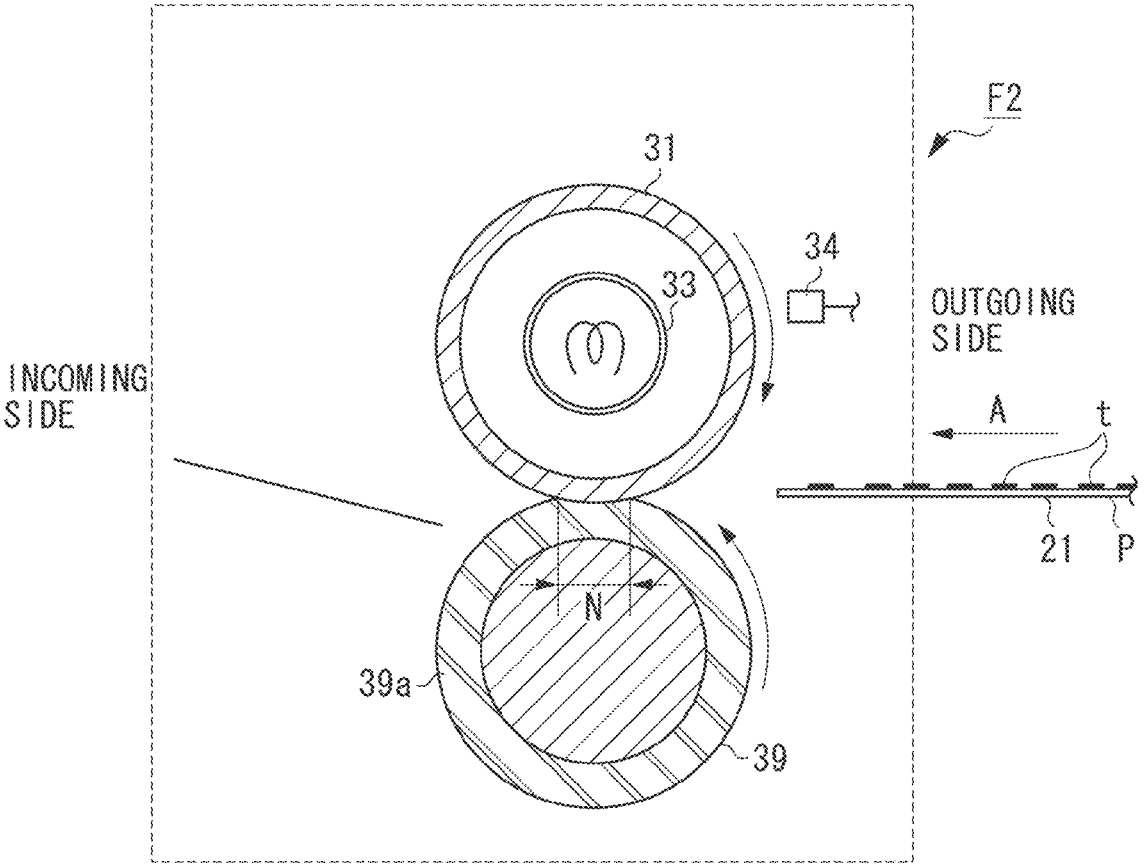

FIG. 3 is an enlarged view of a main portion of the second fixing unit F2 and a block diagram of the control system. The second fixing unit F2 also includes the first and the second rotating members which form a nip portion where the toner image on the sheet is fixed to the sheet. More precisely, the second fixing unit F2 includes the heating roller 31 as a rotatable fixing member and a pressure roller 39 which forms the nip portion N together with the heating roller 31.

The heating roller 31 of the second fixing unit F2 is similar to the heating roller 31 of the first fixing unit F1. The pressure roller 39 is a heat resistant roller having an elastic layer 39*a* and is arranged in parallel with the heating roller 31. The pressure roller 39 is pressed against the heating roller 30 by a predetermined pressure. Accordingly, the nip portion N of a long predetermined width in the paper conveying direction A is formed between the heating roller 31 and the pressure roller 39.

The pressure roller 39 rotates driven according to the rotation of the heating roller 31. Further, the pressure roller 39 may rotate in the direction same as the rotation direction of the heating roller 31 at a circumferential velocity substantially corresponding to the rotation circumferential velocity of the heating roller 31 according to a driving force from a drive source. When the paper P that passed through the first fixing unit F1 is conveyed to the nip portion N, heat and pressure is applied again to the paper P.

(Nozzle Mechanism)

Next, a nozzle mechanism 40, which is an air blowing portion of the first fixing unit F1, will be described. The nozzle mechanism 40 is an air blowing portion configured to blow compressed air to the leading edge of the paper P, which is wrapping around the surface of the heating roller 31, after the paper P passed the nip portion N being the fixing portion. Thus, the nozzle mechanism 40 separates the paper P from the heating roller 31 in a contactless manner. According to the present embodiment, as described above, the nozzle mechanism 40 is set in the separation guide plate 38 provided at the paper outgoing side of the nip portion N. Devices used for blowing compressed air such as the nozzle mechanism 40 as well as an air pump 301 and an output solenoid valve 304 described below are collectively called an air blowing mechanism.

Figure 4A:
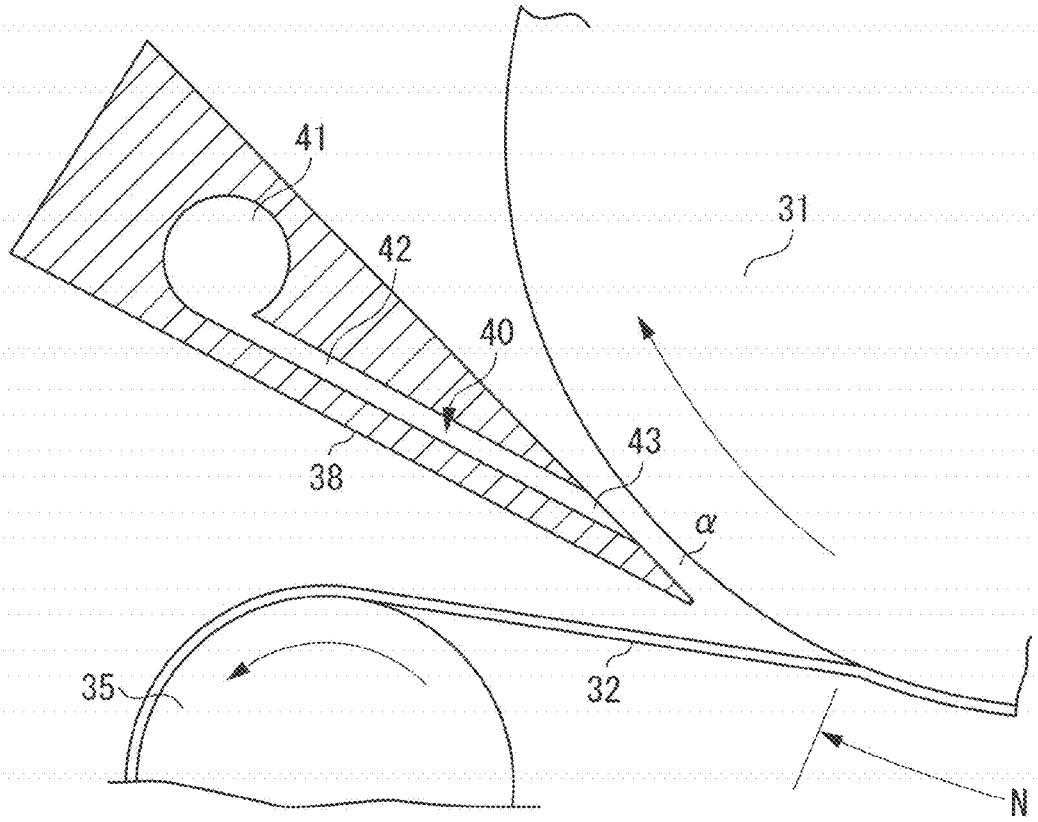
FIG. 4A is an enlarged view of a separation guide plate illustrated in FIG. 2.
Figure 4B:
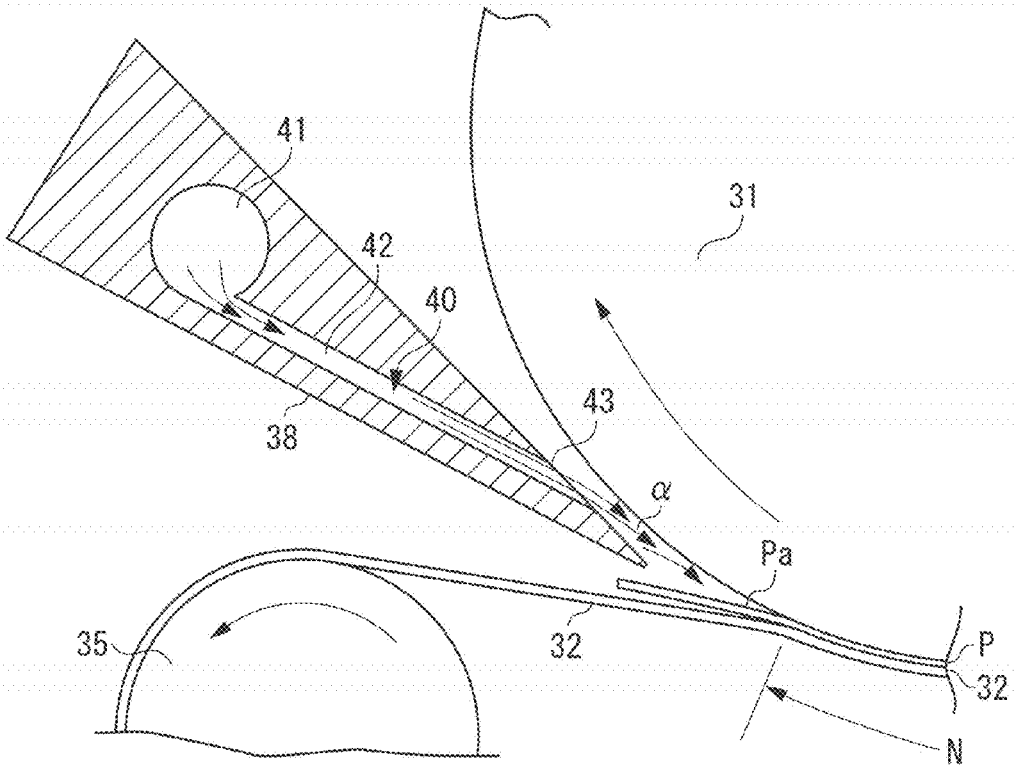
FIG. 4B illustrates the separation guide plate in a state where air is blown from a nozzle mechanism.
Figure 5:
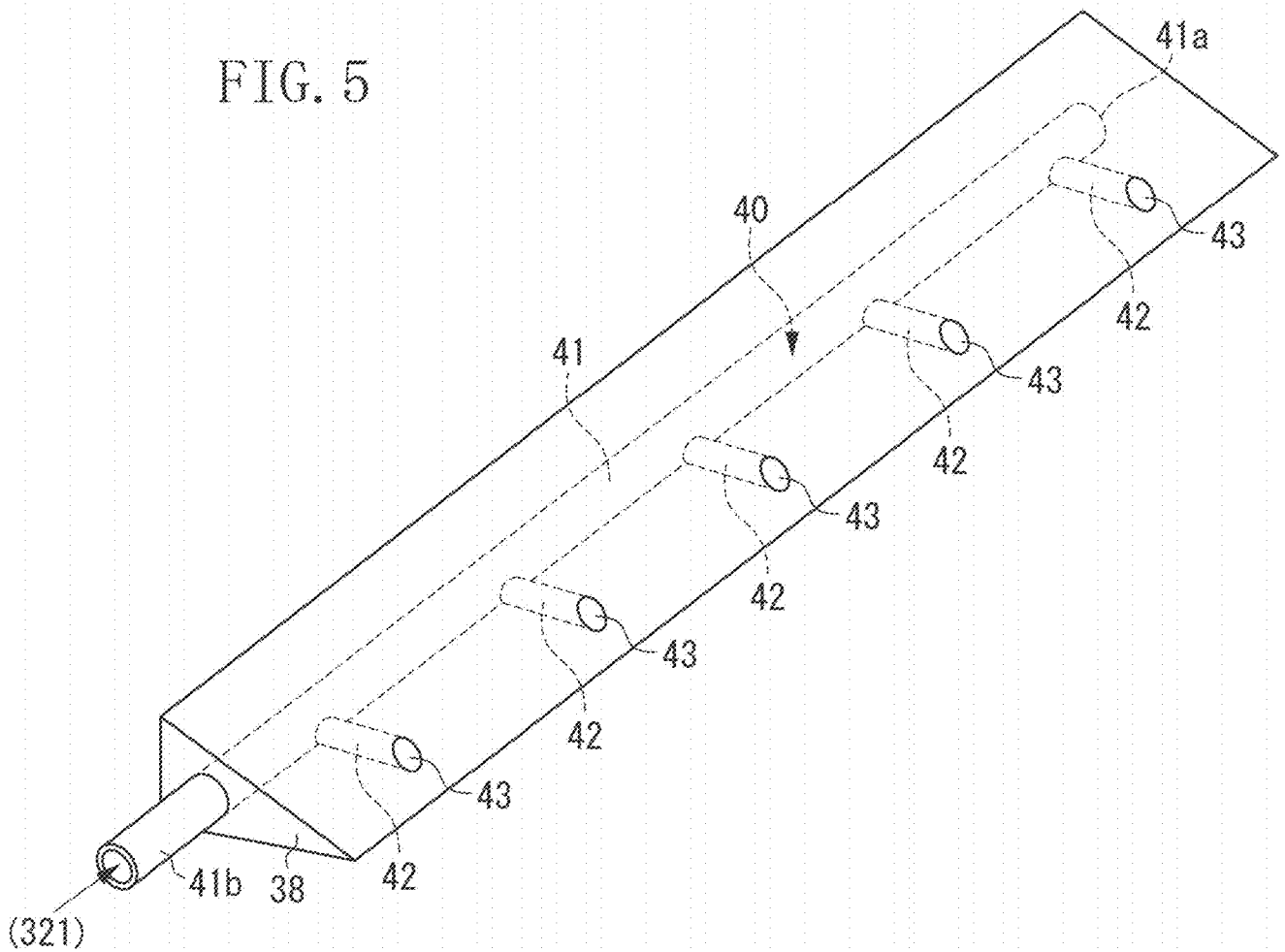
FIG. 5 is a perspective view of the separation guide plate with the nozzle mechanism.

FIG. 4A is an enlarged view of the separation guide plate 38 illustrated in FIG. 2. FIG. 4B illustrates the separation guide plate 38 in a state where a leading edge Pa of the paper P wrapping around the heating roller 31 is separated from the heating roller 31 by the compressed air blown from the nozzle mechanism 40. FIG. 5 is a perspective view of the separation guide plate 38 including the nozzle mechanism 40.

The separation guide plate 38 is a long plate member (tubular portion) which extends in the longitudinal direction of the heating roller 31 (i.e., the direction of the axis of rotation of the heating roller). The cross section of the separation guide plate is wedge-shaped and the tapered end of the wedge shape corresponds to the pointed side of the separation guide plate 38. Inside the thick portion of the separation guide plate 38, an air conduit 41 is provided in the longitudinal direction of the heating roller 31. A termination side 41*a* of the air conduit 41 is closed. A front end side 41*b* of the air conduit 41 protrudes from the side of the separation guide plate 38. A connection air conduit 321 on the side of an air supply mechanism 300 described below is connected to the front end side 41*b* of the air conduit 41.

On the upper portion of the pointed side of the separation guide plate 38, a plurality of apertures (small holes), which are air blowing nozzles, are arranged at predetermined intervals in the longitudinal direction of the separation guide plate 38. The apertures are hereinafter referred to as nozzles 43. Each of the nozzles 43 communicates with the air conduit 41 via a branch conduit 42. When compressed air is supplied from the air supply mechanism 300 to the air conduit 41 via the front end side 41*b*, the air is jetted from each of the nozzles 43 (air knife). In FIG. 4B, an arrow "a" indicates the air that blows out from one of the nozzles 43.

According to the present embodiment, as described above, the nozzle mechanism 40 includes the air conduit 41, the branch conduit 42, and the nozzles 43. All of these components are provided in the separation guide plate 38.

The pointed side of the separation guide plate 38 faces the side of the heating roller 31 at the paper outgoing side of the nip portion N. The upper side of the separation guide plate 38, where the aperture of the nozzle 43 is formed, is set to face the heating roller 31 with the gap a, which is a predetermined small gap, in between.

(Air Supply Mechanism)

Figure 6:
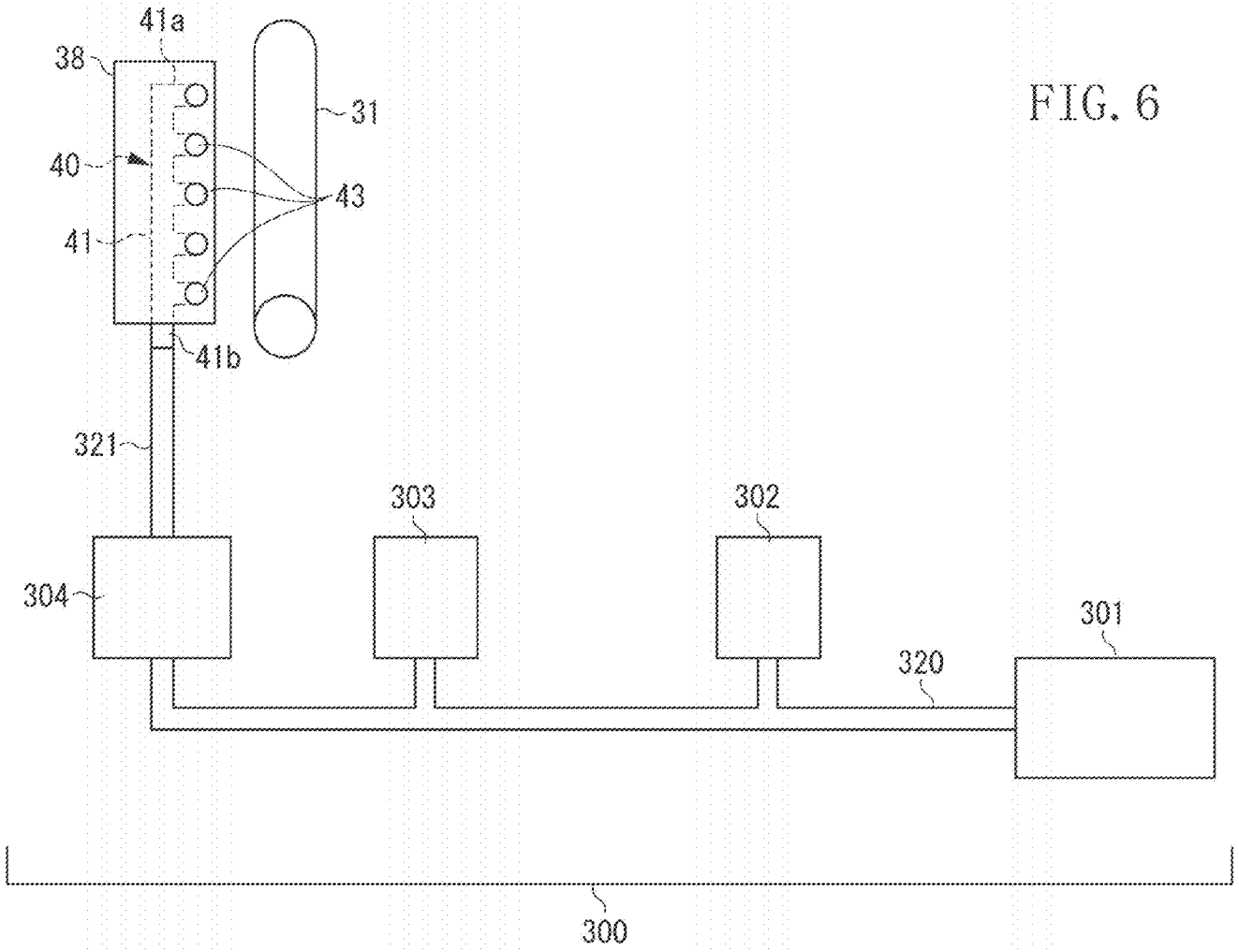
FIG. 6 is a block diagram of an air supply mechanism.

FIG. 6 is a block diagram illustrating the air supply mechanism 300 configured to supply the compressed air to the nozzle mechanism 40. The air supply mechanism 300 according to the present embodiment includes the air pump 301, a connection air conduit 320, and the connection air conduit 321. As described above, the air pump 301 is a motorized pump unit used for compressing air. The connection air conduits 320 and 321 connect the air pump 301 and the nozzle mechanism 40.

Further, the connection air conduits 320 and 321 are connected to an air open valve (air open valve portion) 302, a relief valve 303, and the output solenoid valve 304 arranged in order from the side of the air pump 301 to the side of the nozzle mechanism 40. The air open valve 302 and the output solenoid valve 304 are, as described below, valve units configured to control the supply of air (i.e., supply or not supply the air) compressed by the air pump 301 to the nozzle mechanism 40.

The arrangement order of the air open valve 302 and the relief valve 303 can be reversed. Although the air pump 301 according to the present embodiment is an air pump driven by an AC motor, it is not limited to such an example. The pump 301 is used for pumping compressed air to the connection air conduit 320. Further, the operation of the pump 301 is started and stopped according to the control of the CPU 101.

The air open valve 302 releases the internal pressure of the connection air conduit 320 so that it is kept in equilibrium with the atmosphere. According to the present embodiment, the air open valve 302 is a solenoid valve which is opened/closed by the control of the CPU 101. The air pump 301 cannot be started unless the internal pressure of the connection air conduit 320 is equal to the atmospheric pressure. Thus, before the CPU 101 starts the air pump 301, the CPU 101 opens the air open valve 302 so that the internal pressure of the connection air conduit 320 is in equilibrium with the atmosphere.

The relief valve 303 adjusts the internal pressure of the conduit compressed by the air pump 301 to a predetermined pressure. More precisely, the relief valve 303 adjusts the pressure of the compressed air inside the connection air conduit 320 pumped by the air pump 301. According to the relief valve 303, the air pressure inside the connection air conduit 320 is adjusted to a predetermined pressure. According to the present embodiment, the relief valve 303 adjusts the air pressure of the connection air conduit 320 to 0.3 MPa.

The output solenoid valve 304 is used for supplying or stop supplying the compressed air in the connection air conduit 320 to the nozzle mechanism 40. The output solenoid valve 304 is opened/closed by the CPU 101.

Figure 7:
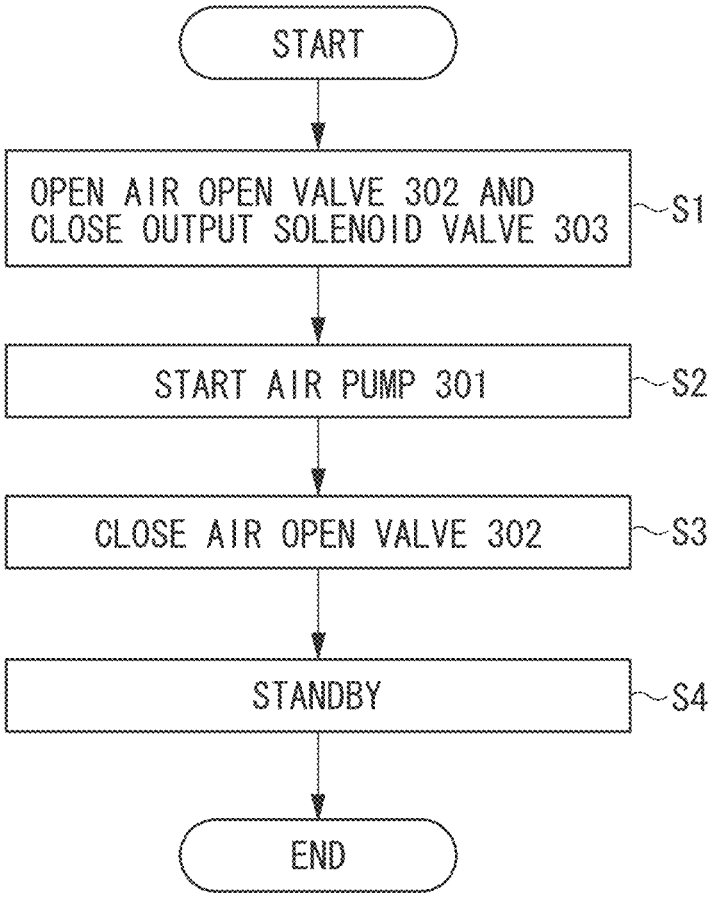
FIG. 7 is a flowchart illustrating the operation of the air supply mechanism when it is started.

FIG. 7 is a control flow diagram of the CPU 101 when the CPU 101 starts the air supply mechanism 300 according to the present embodiment. The CPU 101 starts the air supply mechanism 300 according to a job start signal of the image forming apparatus 100. The CPU 101 also starts the air supply mechanism 300 in association with a preparation operation which is performed when the user turns on a main power switch MSW (see FIG. 9) of the image forming apparatus 100. In step S1, the CPU 101 opens the air open valve 302 if it is closed and closes the output solenoid valve 304 if it is open. In step S2, the CPU 101 starts the air pump 301.

In step S3, when the air pump 301 is started, the CPU 101 closes the air open valve 302. Accordingly, the compressed air generated by the air pump 301 is accumulated in the connection air conduit 320. The air pressure inside the connection air conduit 320 is maintained to the air pressure set by the relief valve 303 (according to the present embodiment, it is set to 0.3 MPa). In step S4, if the air supply mechanism 300 is started based on a job start signal, the mode is changed to the standby mode. In this state, the print command is acceptable and the printing can be immediately started.

Further, if the air supply mechanism 300 is started in association with the preparation operation performed by the user turning on the main power switch MSW of the image forming apparatus 100, the CPU 101 stops the drive of the air pump 301. The CPU 101 starts the air pump 301 again when a job start signal is received.

If the output solenoid valve 304 serves as the air open valve 302, the air supply mechanism 300 can be configured without the air open valve 302. In such a case, when the air supply mechanism 300 is started, the output solenoid valve 304 is opened before the air pump 301 is started. Then, after the air pump 301 is started, the output solenoid valve 304 is closed. In this manner, the compressed air generated by the air pump 301 is accumulated in the connection air conduit 320. The internal pressure of the connection air conduit 320 is maintained to the air pressure set by the relief valve 303.

(Air Supply ON/OFF Mode)

Next, the air supply ON/OFF mode of the air supply mechanism 300 will be described. When the air supply mechanism 300 is in the air supply ON mode, the compressed air is supplied to the nozzle mechanism 40. When the air supply mechanism 300 is in the air supply OFF mode, the supply of the compressed air will be stopped.

In a state where the air supply mechanism 300 is maintained in the standby mode after the image forming apparatus 100 has been started based on a job start signal or a paper feeding start signal of paper of a predetermined grammage or less, the CPU 101 opens the output solenoid valve 304 at predetermined control timing. Accordingly, the compressed air in the connection air conduit 320 is supplied to the nozzle mechanism 40 via the connection air conduit 321 and jetted from each of the nozzles 43. Further, when the output solenoid valve 304 is closed at predetermined control timing, the state of the air supply mechanism 300 is changed to the closed state. Accordingly, the supply of the compressed air in the connection air conduit 320 to the nozzle mechanism 40 is stopped and the blow of air from each of the nozzles 43 is stopped.

Figure 8:
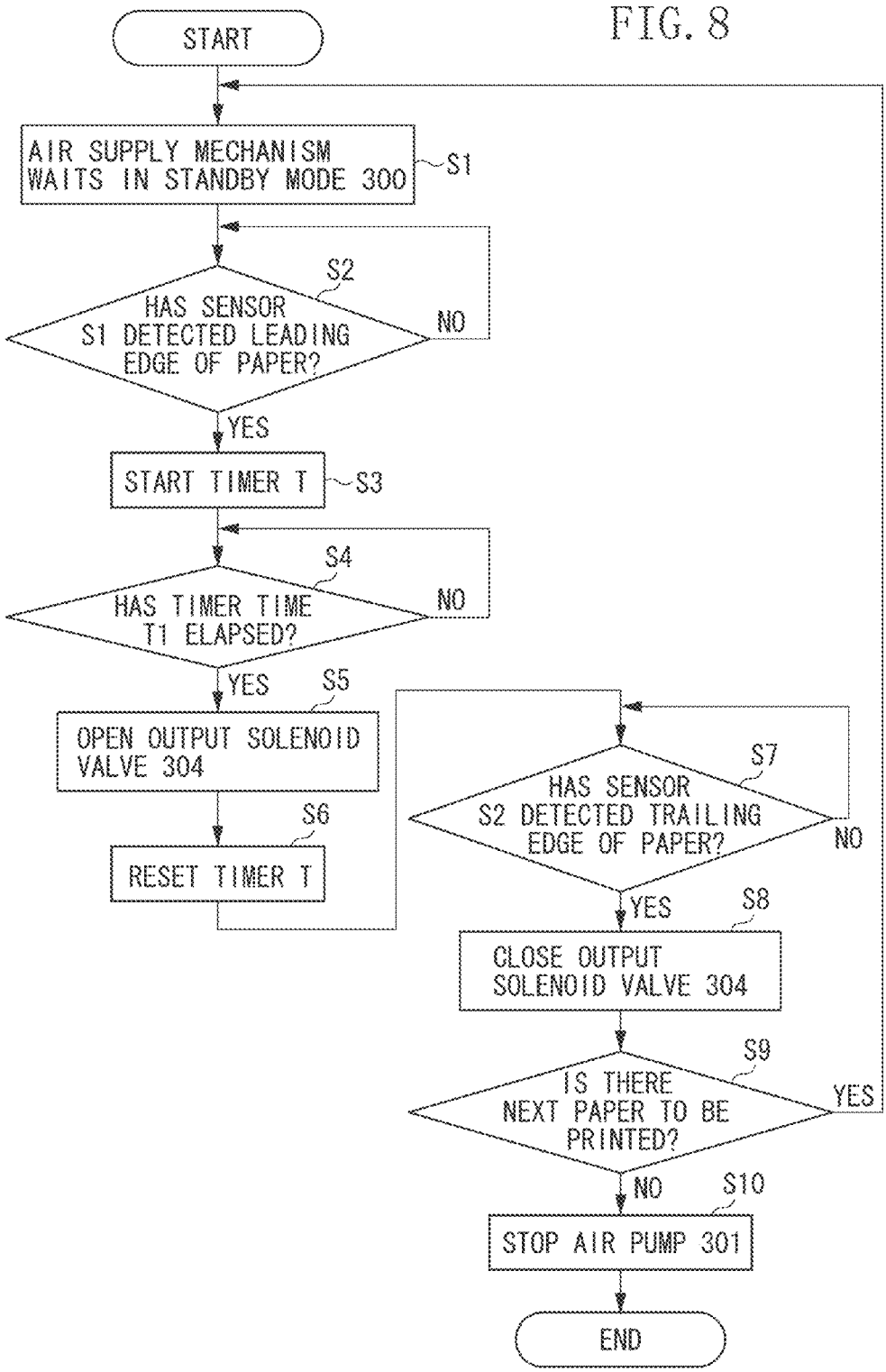
FIG. 8 is a flowchart illustrating the operation of the air supply mechanism in an air supply ON/OFF mode.

FIG. 8 is a control flow diagram of the CPU 101 controlling the air supply mechanism 300 in the air supply ON/OFF mode according to the present embodiment. In step S1, since the air pump 301 is started as described with reference to FIG. 7, the air supply mechanism 300 is in the standby mode. According to the present embodiment, the paper detection sensor S1 provided on the paper incoming side of the first fixing unit F1 is used for determining the blow start timing of the compressed air from each of the nozzles 43 of the nozzle mechanism 40.

In step S2, the CPU 101 determines whether the sensor S1 is "ON" according to a detection signal and further determines whether the leading edge of the paper P conveyed from the image forming unit 1 has reached the first fixing unit F1 according to the detection signal. If the sensor S1 is "ON" (YES in step S2), the processing proceeds to step S3. If the sensor S1 is "OFF" (NO in step S2), the processing in step S2 is repeated. In step S3, the CPU 101 starts a timer T (see FIG. 9) according to the detection signal. In step S4, the CPU 101 determines whether a predetermined time T1 has elapsed from the time the sensor S1 has been "ON". The predetermined time T1 is the time required from when the leading edge of the paper P passed the nip portion N and reached the paper outgoing side Nb of the nip portion N. If the predetermined time T1 has elapsed (YES in step S4), the processing proceeds to step S5. If the predetermined time T1 has not yet elapsed (NO in step S4), the processing in step S4 is repeated. In step S5, at timing the predetermined time T1 has elapsed, the CPU 101 opens the output solenoid valve 304 and changes the state of the air supply mechanism 300 to the open state. In step S6, the CPU 101 resets the timer T.

When the output solenoid valve 304 is opened, the compressed air is supplied from the air supply mechanism 300 to the nozzle mechanism 40. Accordingly, as "a" in FIG. 4B indicates, the compressed air is jetted from each of the nozzles 43 of the nozzle mechanism 40 to the heating roller 31. Accordingly, the leading edge Pa of the paper P that passed the nip portion N and is wrapping around the heating roller 31 is separated from the heating roller 31 by the compressed air according to a contactless method.

The leading edge Pa which has been separated is further separated from the face of the heating roller 31 according to the continuous blow of the compressed air from each of the nozzles 43 of the nozzle mechanism 40 and is flexed to the side of the pressure application belt 32 against the resilience of the paper. Subsequently, according to the paper conveying power of the pressure application belt 32 at the nip portion N, the paper P is guided to the gap between the pressure application belt 32 and the separation guide plate 38. Then, by the continuous paper conveying power at the nip portion N, the portion of the paper P which has been separated from the heating roller 31, is further conveyed to the paper outgoing side of the fixing unit F1 under the separation guide plate 38.

According to the present embodiment, the sensor S2 provided on the paper outgoing side of the first fixing unit F1 is used for the generation of the stop timing of the air blow from each of the nozzles 43. Thus, in step S7, the CPU 101 determines whether the sensor S2 is "ON" according to a detection signal (determines whether the trailing edge of the paper P supplied to the first fixing unit F1 has been detected according to the detection signal). If the sensor S2 is "ON" (YES in step S7), the processing proceeds to step S8. If the sensor S2 is "OFF" (NO in step S7), the processing in step S7 is repeated. In step S8, at timing the detection signal has been input, the CPU 101 closes the output solenoid valve 304 and changes the state of the air supply mechanism 300 to the closed state. In this manner, the air blow from each of the nozzles 43 of the nozzle mechanism 40 is stopped.

In step S9, the CPU 101 determines whether the next paper exists. If the next paper exists (YES in step S9), the processing returns to step S1 and the above-described air supply ON/OFF step is repeated. If the next paper does not exist (NO in step S9), the air pump 301 is stopped. The air supply mechanism 300 is started again when a next job start signal is received. The air supply mechanism 300 is also started when a paper feeding start signal of paper of a predetermined grammage or less, which is, in other words, thin paper (see FIG. 7), is received.

The stop timing of the air blow from each of the nozzles of the nozzle mechanism 40 is not limited to the above-described timing. In other words, the stop timing of the air blow can be set at a predetermined point in time between when the air blow from each of the nozzles 43 has been started and when the trailing edge of the paper P has passed the nip portion N.

(Control System of Air Supply Mechanism)

Figure 9:
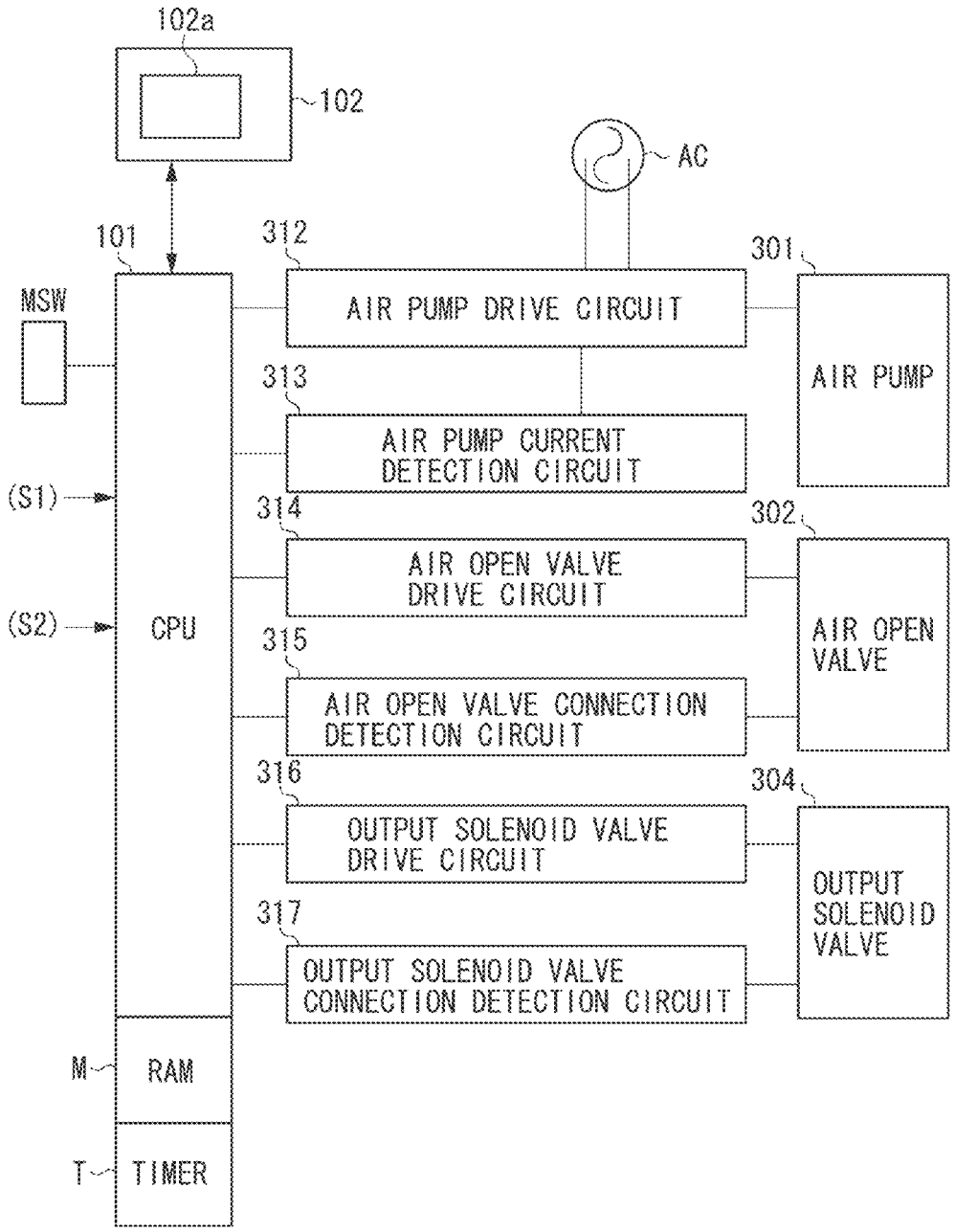
FIG. 9 is a control block diagram of the air supply mechanism.

FIG. 9 is a block diagram illustrating a control system of the air supply mechanism 300 illustrated in FIG. 6. The CPU 101 outputs signals to control each of the air pump 301, the air open valve 302, and the output solenoid valve 304. Each of the signals is input in an air pump drive circuit 312, an air open valve drive circuit 314, and an output solenoid valve drive circuit 316.

When the air pump drive circuit 312 receives an "ON" command signal (drive signal) from the CPU 101, it starts the air pump 301. When the air pump drive circuit 312 receives an "OFF" command signal (stop drive signal), it stops the air pump 301. Since an AC motor is used for the air pump 301 according to the present embodiment, an AC power supply is connected to the air pump drive circuit 312. The air pump 301 is turned ON or OFF according to a relay in the drive circuit.

An air pump current detection circuit 313 is a current detecting unit configured to detect the drive current necessary for the generation of a predetermined pressure of the air pump 301. The air pump current detection circuit 313 detects the drive current which has been branched from the air pump drive circuit 312 to the air pump 301. Further, the air pump current detection circuit 313 outputs a detection signal (associated with the drive current detection level or the detection current value) to the CPU 101.

When the air open valve drive circuit 314 receives an "ON" command signal (open drive signal) from the CPU 101, it opens the air open valve 302. When the air open valve drive circuit 314 receives an "OFF" command (close drive signal), it closes the air open valve 302. Further, the control system of the air supply mechanism 300 includes an air open valve connection detection circuit 315 which is an air open valve connection detection unit configured to detect the electric connection of the air open valve 302 to the CPU 101.

When the output solenoid valve drive circuit 316 receives an "ON" command signal (open drive signal) from the CPU 101, it opens the output solenoid valve 304 . When the output solenoid valve drive circuit 316 receives an "OFF" command (close drive signal), it closes the output solenoid valve 304. Further, the control system of the air supply mechanism 300 includes an output solenoid valve connection detection circuit 317 which is configured to detect the electric connection of the output solenoid valve 304 to the CPU 101.

The air open valve connection detection circuit 315 determines whether the signal line of the air open valve 302 is correctly connected to the air open valve connection detection circuit 315 and outputs a detection signal to the CPU 101. Similarly, the output solenoid valve connection detection circuit 317 determines whether the signal line of the output solenoid valve 304 is correctly connected to the output solenoid valve connection detection circuit 317 and also outputs a detection signal to the CPU 101.

Figure 10:
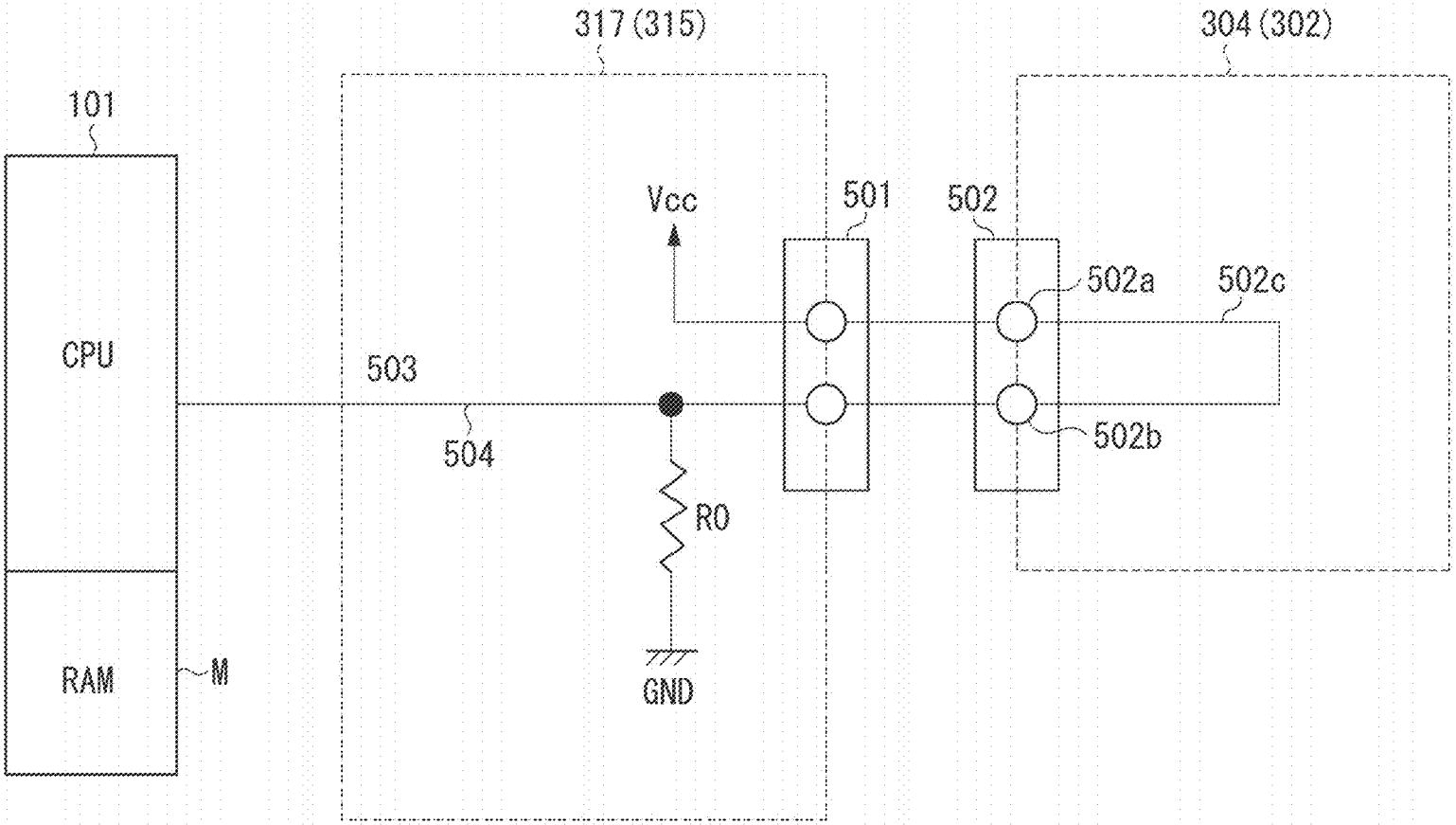
FIG. 10 illustrates a configuration of a connection detection circuit.

FIG. 10 illustrates the output solenoid valve connection detection circuit 317 used in the present embodiment. A voltage Vcc (e.g., 5V) is output from a connector 501 of the output solenoid valve connection detection circuit 317. The output solenoid valve connection detection circuit 317 is connected to a connector 502 on the side of the output solenoid valve 304 by a signal line. Regarding the output solenoid valve 304, two pins 502*a* and 502*b* of the connector 502 are connected via a loopback line 502*c*. Thus, the output solenoid valve 304 is connected to the output solenoid valve connection detection circuit 317 via the connector 501.

Between a signal line 504 and GND of the output solenoid valve connection detection circuit 317, there is connected a resistor R0. A connection detection signal 503 is input in the CPU 101. If the connector 502 on the side of the output solenoid valve 304 is connected to the connector 501 on the side of the output solenoid valve connection detection circuit 317, the connection detection signal 503 indicates active high logic. If the connector 502 is disconnected, the connection detection signal 503 indicates active low logic. The CPU 101 determines whether the output solenoid valve 304 is electrically connected to the CPU 101 based on the active high logic and the active low logic. The configuration of the air open valve connection detection circuit 315 is similar to that of the output solenoid valve connection detection circuit 317.

The connection detection circuit described above according to the present embodiment is an example and a different circuit configuration can be used so long as the electrical connection/disconnection of the output solenoid valve 304 and the air open valve 302 to the CPU 101 can be determined.

Figure 11:
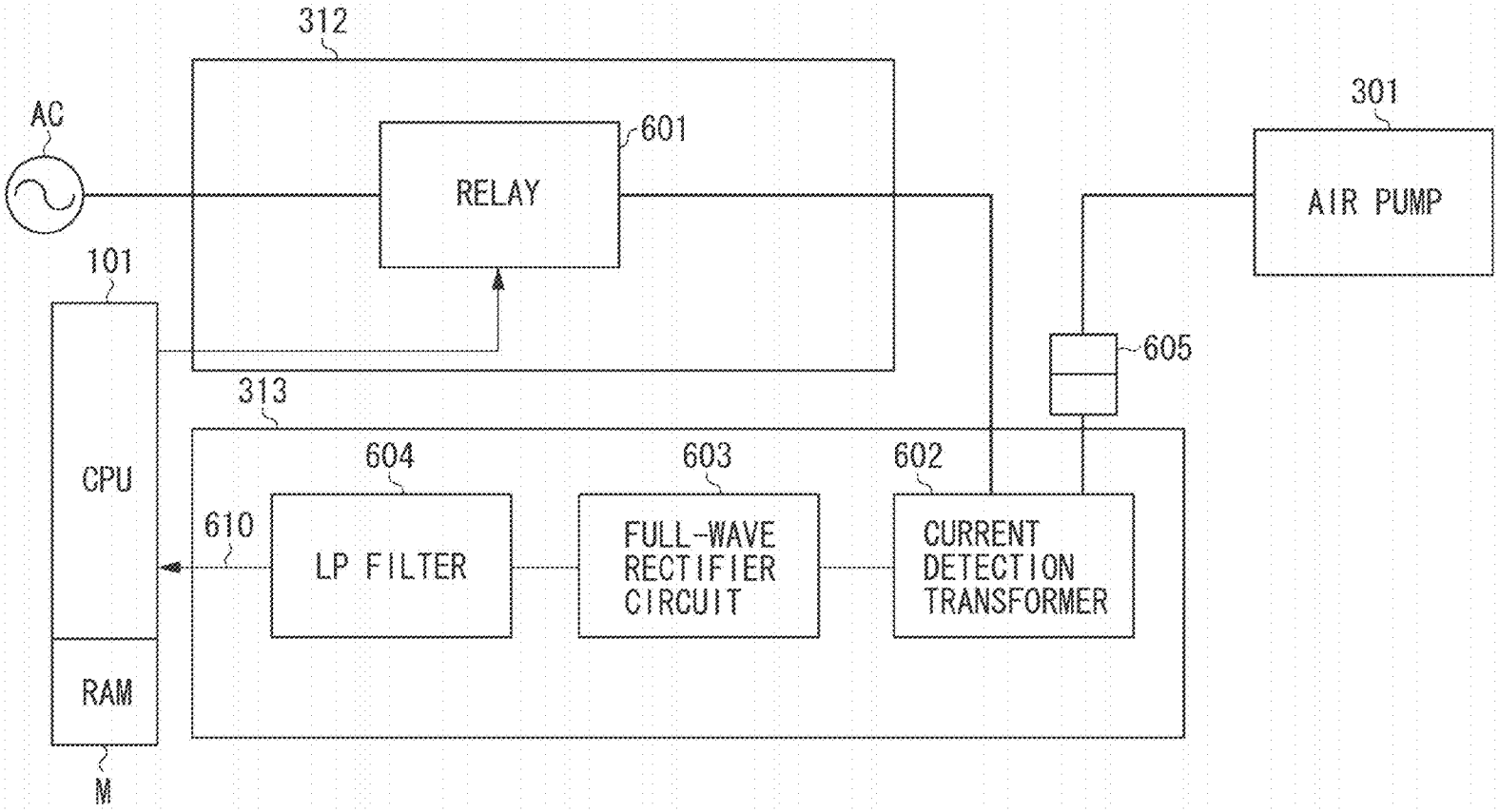
FIG. 11 is a block diagram illustrating an air pump drive circuit and an air pump current detection circuit.

FIG. 11 is a block diagram illustrating the air pump drive circuit 312 and the air pump current detection circuit 313 illustrated in FIG. 9 and used in the present embodiment. When the alternating current is input in the air pump drive circuit 312 and the CPU 101 outputs a relay "ON" signal 611, a relay 601 is turned "ON" and the alternating current is supplied to the air pump 301.

The air pump current detection circuit 313 rectifies a signal output from a current detection transformer 602, which is connected to the relay 601, by a full-wave rectifier circuit 603. After the high frequency component is removed by a low-pass (LP) filter 604, the signal is input in the CPU 101 as a current detection signal 610. The current detection signal 610 is an analog signal. Thus, the CPU 101 can detect the drive current that flows in the air pump 301 at real time. The air pump drive circuit 312 and the air pump current detection circuit 313 are not limited to the above-described circuits and can be different circuits so long as they can detect the drive and the current of the air pump 301.

(State Determination Mode)

If, for example, the output solenoid valve 304 of the air supply mechanism 300 does not open/close normally, the compressed air cannot be supplied from the air supply mechanism 300 to the nozzle mechanism 40, or a sufficient predetermined amount of compressed air cannot be supplied to the nozzle mechanism 40, or the compressed air may be continuously blown from the nozzle mechanism 40. In such cases, the paper P may not be separated from the heating roller 31. If a jam occurs, recovering the jam takes time.

Thus, according to the present embodiment, a state determination mode is provided. When the image forming apparatus 100 is in this mode, the CPU 101 determines whether the air supply mechanism 300 is operating normally. The CPU 101 starts the state determination mode according to a job start signal of the image forming apparatus 100. The CPU 101 also starts the state determination mode in association with the preparation operation which is performed when the user turns on the main power switch MSW of the image forming apparatus 100. According to this state determination mode, whether the air supply mechanism has failed can be determined before the job is executed and the occurrence of a paper jam due to separation failure can be prevented. The state determination mode according to the present embodiment will be described in detail below.

Figure 12:
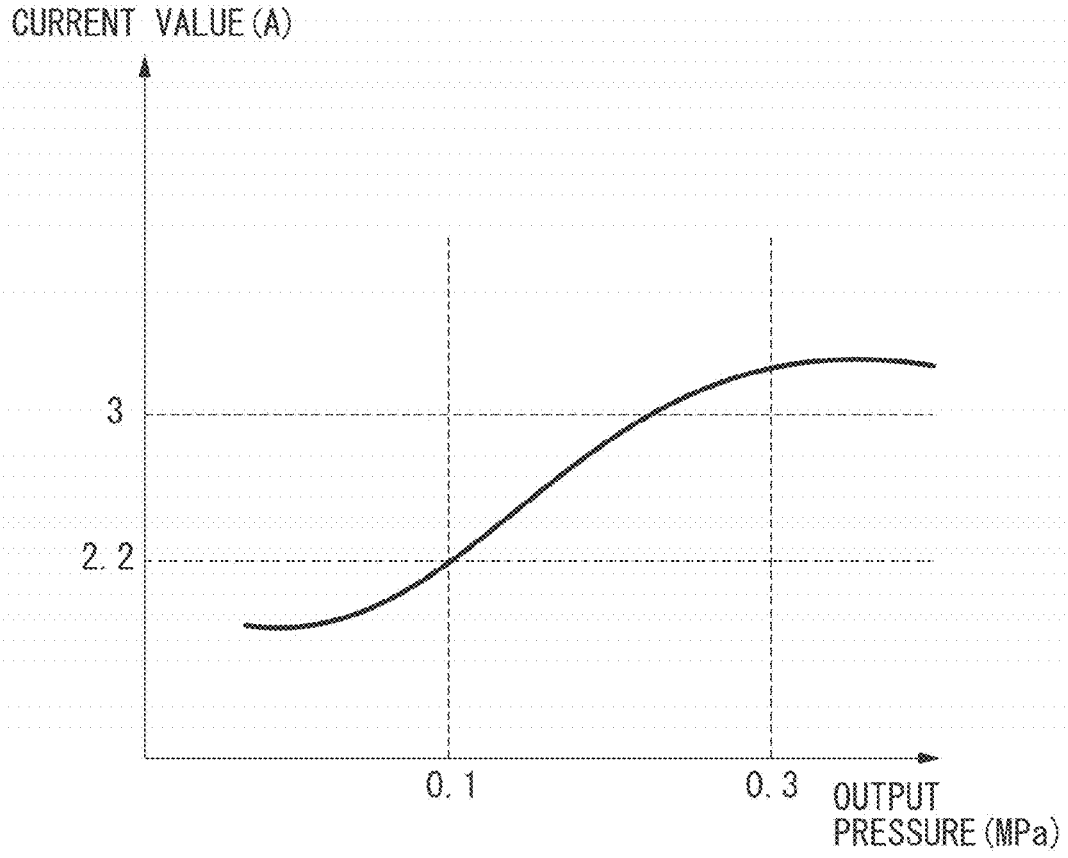
FIG. 12 is a graph illustrating a change in a current value with respect to an output pressure of an air pump.

FIG. 12 is a graph illustrating the change in the drive current value with respect to the output pressure of the air pump 301. When the output pressure increases, the drive current value of the air pump 301 also increases. If the air pump 301 is normally started and both of the air open valve 302 and the output solenoid valve 304 are normally closed, according to the present embodiment, the setting pressure of the relief valve 303 is 0.3 MPa and the drive current value of the air pump 301 at that time will be about 3 A. In this state, if the output solenoid valve 304 is opened normally, the internal pressure of the connection air conduit 320 is reduced. Accordingly, the output pressure of the air pump 301 is reduced to about 0.1 MPa and the drive current value of the air pump 301 is reduced to 2.2 A.

Figure 13:
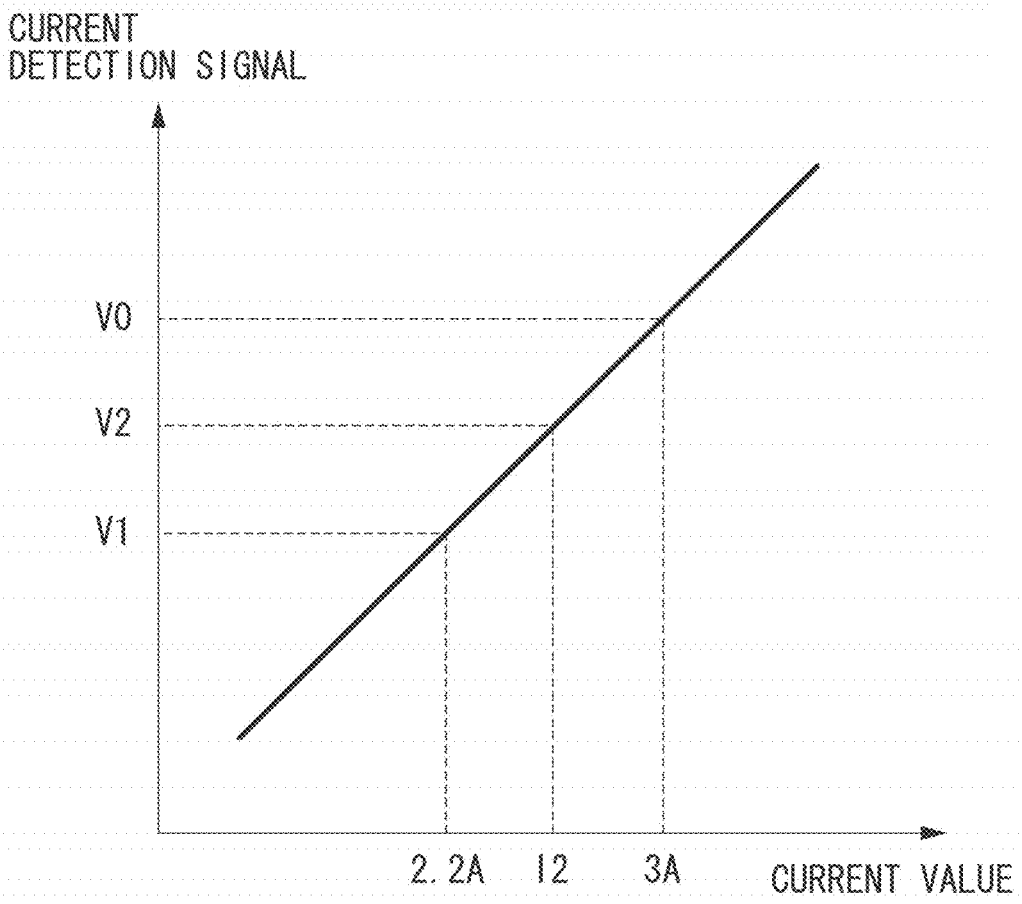
FIG. 13 illustrates a relation between a current value of the air pump and a signal input into a central processing unit (CPU).

FIG. 13 illustrates a relation between the drive current value of the air pump 301 and the voltage value obtained by converting the current value into a signal to be input in the CPU 101 via the air pump current detection circuit 313 (converted value of the drive current value). The voltage value corresponding to the current value 3 A is expressed as V0 and the voltage value corresponding to the current value 2.2 A is expressed as V1. Further, the voltage value corresponding to an arbitrary current value I2 between 3 A and 2.2 A is expressed as V2.

Figure 14A:
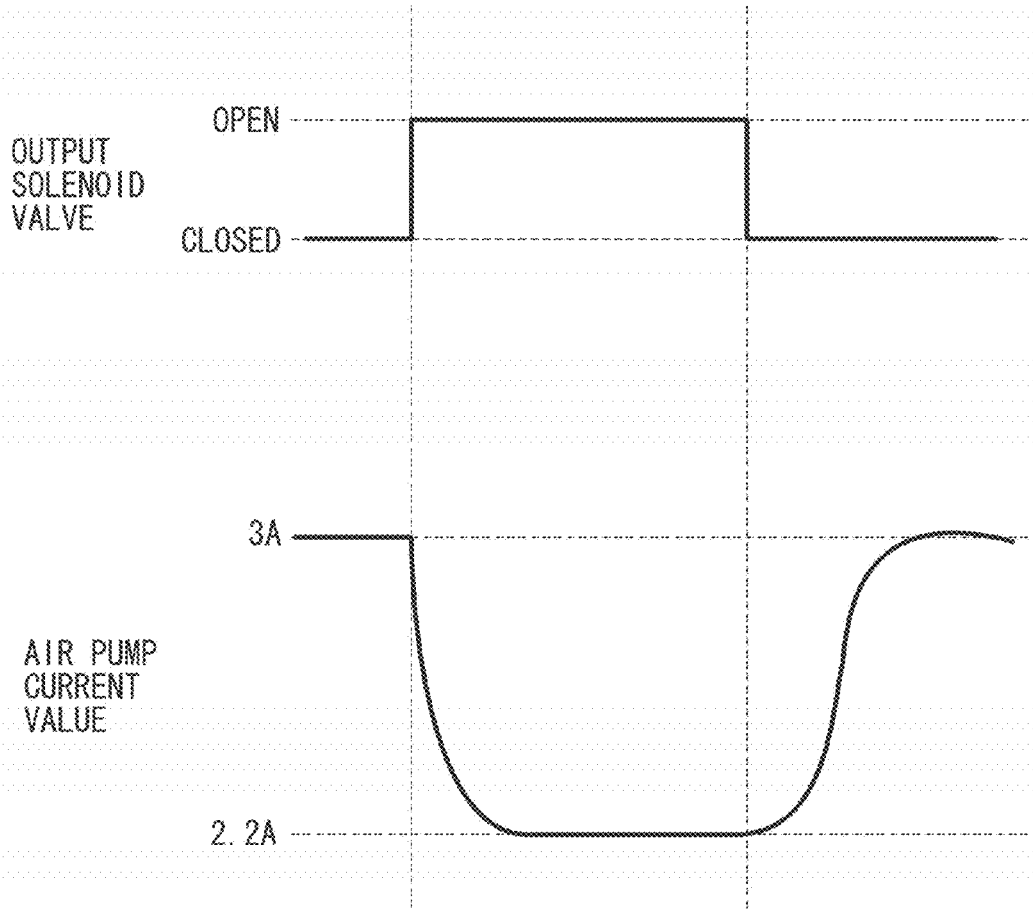
FIG. 14A illustrates a current change in the air pump when an output solenoid valve is opened from a closed state in a case where the output solenoid valve is in a normal state.

FIG. 14A illustrates a current change when the output solenoid valve 304 is opened from the closed state while the air pump 301 is operating normally. When the output solenoid valve 304 is in the closed state, the current detection signal 610 of the air pump 301 indicates the voltage value V0 which corresponds to about 3 A. If the output solenoid valve 304 is opened, since the compressed air in the connection air conduit 320 is discharged, the pressure of the connection air conduit 320 will be reduced.

According to the present embodiment, when the output solenoid valve 304 is opened, the pressure inside the connection air conduit 320 is reduced by the relief valve 303 from the defined value 0.3 MPa to about 0.1 MPa. Thus, the current detection signal 610 of the air pump 301 at that time (see FIG. 11) is averaged by the CPU 101. Accordingly, the voltage value V1 corresponding to about 2.2 A is obtained.

Figure 14B:
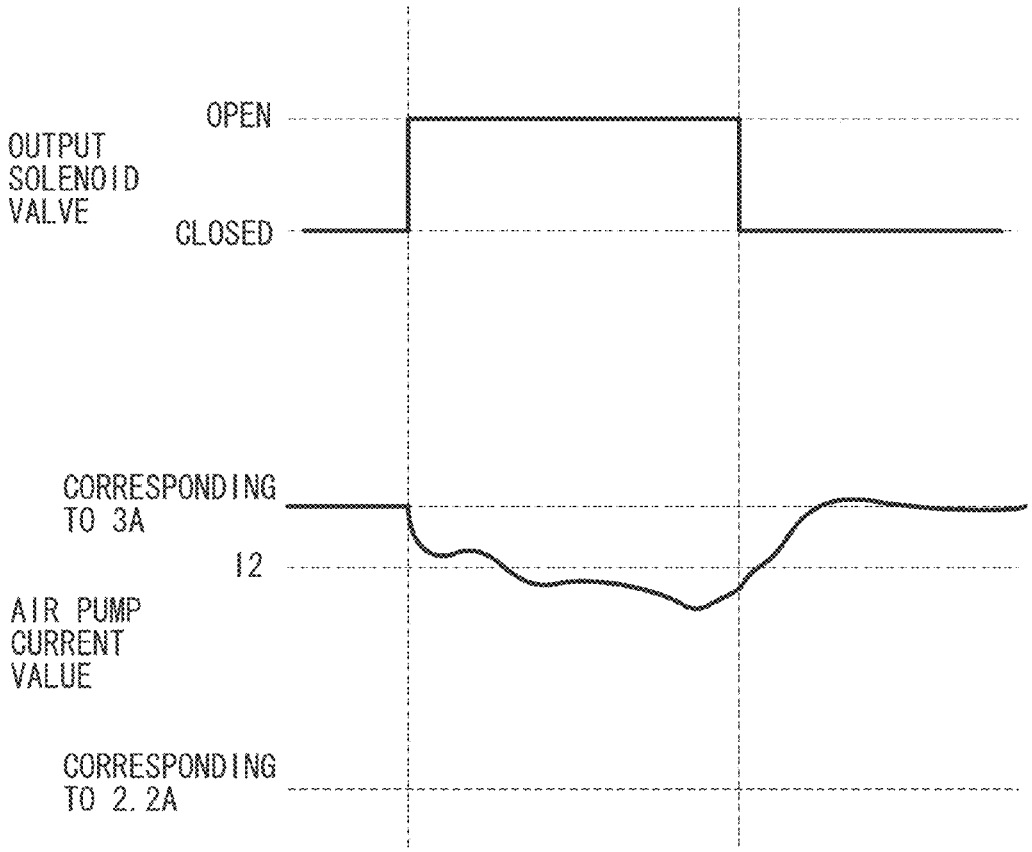
FIG. 14B illustrates a current change in the air pump when the output solenoid valve is opened from a closed state in a case where the output solenoid valve is in an abnormal state.

FIG. 14B illustrates the current value of the air pump 301 when the output solenoid valve 304 is not normally opened from the closed state (i.e., the valve is not fully opened). Although the pressure in the connection air conduit 320 gradually lowers, since the output solenoid valve 304 is not fully opened, the downward slope becomes less steep. During the open time of the output solenoid valve 304, which is 350 msec according to the present embodiment, the current value is not decreased to 2.2 A. The average current value during the open time 350 msec of the output solenoid valve 304 is calculated by the CPU 101. The obtained average current value is expressed as 12.

Further, if the output solenoid valve 304 remains closed and is not opened, it is clear that a current of about 3 A flows in a continuous manner.

Thus, whether the output solenoid valve 304 is normally operating can be determined based on the events of the above-described FIGS. 14A and 14B. In other words, whether the solenoid valve is normally operating can be determined by monitoring the drive current of the air pump 301 and checking the drive current value of the air pump 301 which changes according to the output pressure of the air pump 301 which is associated with the open/close operation of the solenoid valve. Further, a converted value of the drive current value can be used in place of the drive current value.

According to the present embodiment, the CPU 101 compares the voltage value corresponding to the drive current value of the air pump 301 when the output solenoid valve 304 is closed and the voltage value of the air pump 301 in the drive open state when the output solenoid valve 304 is closed. As illustrated in FIG. 14A, if the output solenoid valve 304 is closed normally, the current detection signal 610 is V0 when the output solenoid valve 304 is closed. Further, if the output solenoid valve 304 is opened normally, the current detection signal 610 is V1 when the output solenoid valve 304 is opened. If V0−V1 is equal to or greater than a predetermined voltage Vth, the CPU 101 determines that the output solenoid valve 304 is normally performing the open/close operation.

In other words, the CPU 101 determines whether the output solenoid valve 304 is operating normally based on the drive current value obtained when a command for causing the output solenoid valve 304 to open is output from the CPU 101 and the drive current value obtained when a command for causing the output solenoid valve 304 to close is output from the CPU 101.

On the other hand, as illustrated in FIG. 14B, if the output solenoid valve 304 is not opened normally from the closed state, the current detection signal 610 of the air pump 301 in the closed state corresponds to V0 and the current detection signal 610 of the air pump 301 in the open state corresponds to V2. At this time, if V0−V2 is equal to or less than the predetermined voltage Vth, it is assumed that the output solenoid valve 304 is not operating normally. The predetermined voltage Vth is stored in a memory M, such as a random access memory (RAM), in the CPU 101. The predetermined voltage Vth can be set to an arbitrary value.

The above-described relation will be described as an operation of the CPU 101 with reference to the flowchart in FIG. 15. The CPU 101 starts the processing in the flowchart when a job of the image forming apparatus 100 is started. The CPU 101 also starts the processing as a preparation operation which is performed when the user turns on the main power switch MSW of the image forming apparatus 100. In either case, the operation starts when the air pump 301 is started up to activate the air supply mechanism 300.

In step S101, as an initial state, if the air open valve 302 is closed, the CPU 101 opens it. Further, as an initial state, if the output solenoid valve 304 is open, the CPU 101 closes it. In step S102, the CPU 101 starts the air pump 301. In step S103, the CPU 101 closes the air open valve 302. In step S104, the CPU 101 stores the detection value of the current detection signal 610 at that time in the memory M as V0.

In step S105, the CPU 101 opens the output solenoid valve 304 at predetermined timing. In step S106, the CPU 101 stores the detection value of the current detection signal 610 at that time in the memory M as V1 in an area different from where V0 is stored. In step S107, the CPU 101 calculates V0−V1 by using the values stored in steps S104 and S106 and compares the obtained value with the predetermined threshold value Vth. If V0−V1≥Vth (YES in step S107), the CPU 101 determines that the output solenoid valve 304 is operating normally, and the processing proceeds to step S108. In step S108, the CPU 101 performs the normal operation. The normal operation is an operation associated with the job execution or an operation performed after the drive of the air pump 301 is stopped and other necessary preparation operations are executed.

On the other hand, if V0−V1<Vth (NO in step S107), the CPU 101 determines that the output solenoid valve 304 is not operating normally, and the processing proceeds to step S109. In step S109, the CPU 101 stops the start of the job of the image forming apparatus 100. In step S110, the CPU 101 closes the output solenoid valve 304. This is because if the output solenoid valve 304 is maintained in the energized state, abnormal heat due to the continuous current flow through the coil may be generated.

In step S111, the CPU 101 stops the air pump 301. This is because when the output solenoid valve 304 does not operate and is unable to blow out the compressed air normally, if the air pump 301 operates continuously, electricity will be wasted.

In step S112, the CPU 101 notifies the user of the negative impact caused by the failure of the output solenoid valve 304. FIG. 16 illustrates an example of a screen displayed in step S112 in FIG. 15. The screen, on which the user selects the paper to be used, is displayed on the information display unit 102*a* of the operation panel unit 102. The CPU 101 grays out the check box corresponding to thin paper which cannot be used. Simultaneously, a message such as "Paper type is limited." is displayed at the bottom of the screen. Thus, at this time, the CPU 101 controls various units of the image forming apparatus 100 so that image forming processing can accept paper other than thin paper (i.e., paper of a grammage equal to or less than a predetermined grammage). In other words, the CPU 101 controls the various units so that processing for fixing paper of a predetermined grammage or greater is accepted.

That is, if the CPU 101 determines that the air supply mechanism 300 is in an abnormal state, the CPU 101 displays a message on the information display unit 102*a* notifying the user that only a particular type of paper (recording material) is accepted by the fixing unit F1. Accordingly, the use of resilient paper (paper of a predetermined grammage or greater) which can be separated from the heating roller 31 without the blow of compressed air from the nozzle mechanism 40 is permitted. Thus, some type of paper can be dealt with. This helps reduce the downtime.

Figure 15:
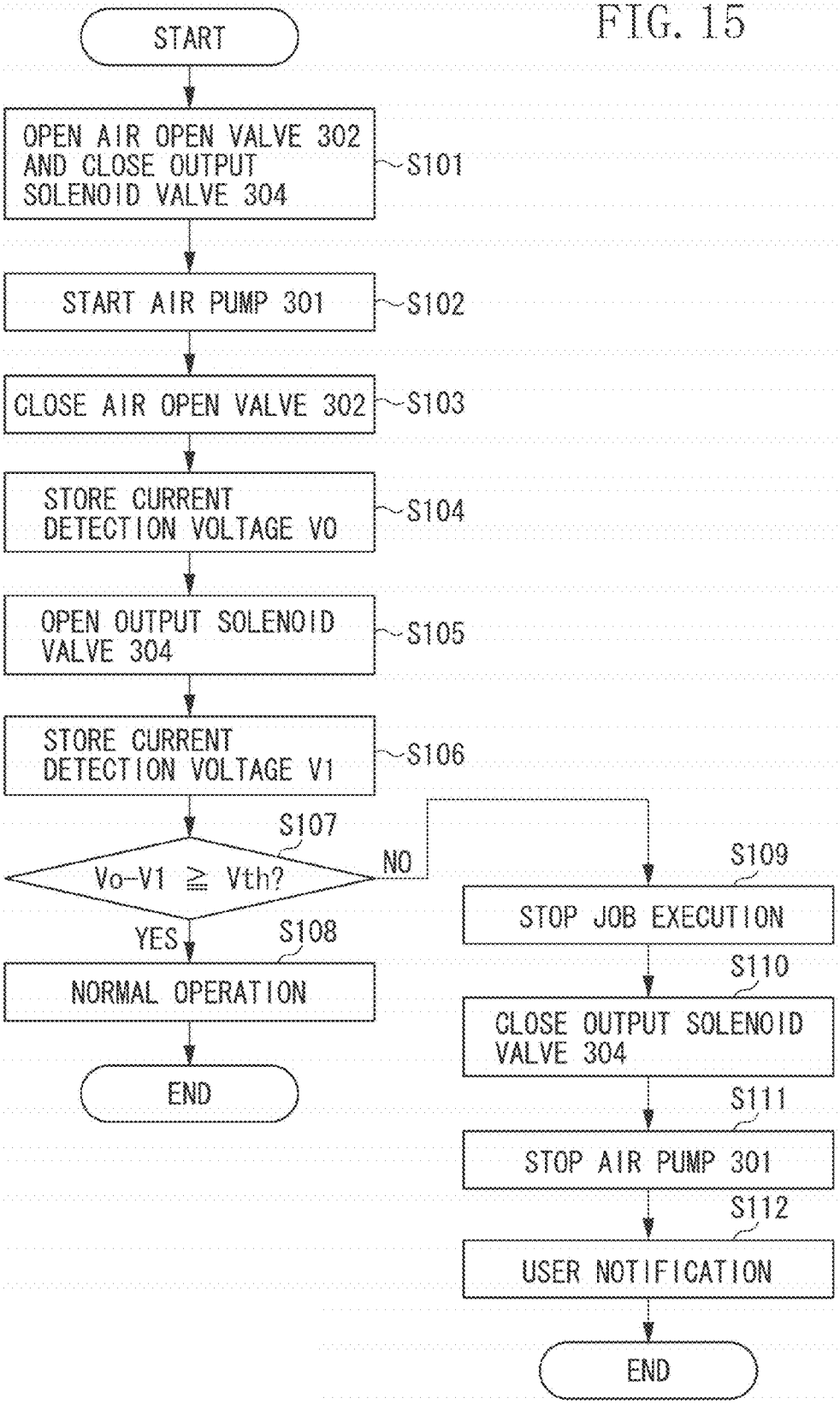
FIG. 15 is a flowchart illustrating the control of the CPU according to the first exemplary embodiment.
Figure 16:
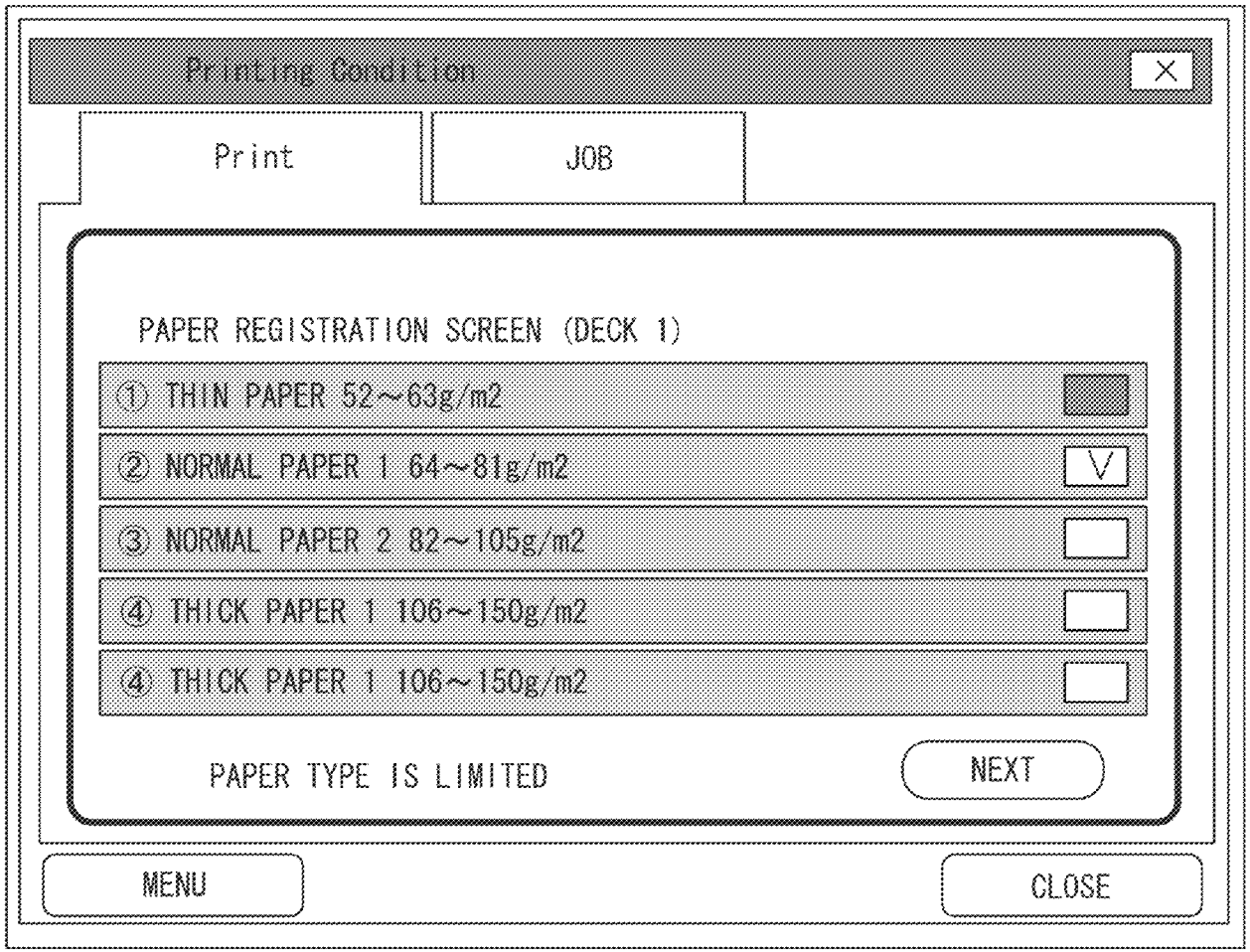
FIG. 16 illustrates a message displayed on a display unit when an abnormality is detected.

If the output solenoid valve 304 is closed and the air open valve 302 is also closed in step S101 in the flowchart in FIG. 15, the air pump 301 is not started in step S102. Thus, the drive current value of the air pump 301 detected by the air pump current detection circuit 313 is 0. Accordingly, the air open valve 302 can be determined as in an abnormal state.

Further, in step S101, if the air open valve 302 is continuously in the open state, even if the air open valve 302 is closed in step S103, the drive current value of the air pump 301 detected in step S104 is not increased. Thus, the output solenoid valve 304 can be determined as in an abnormal state.

Figure 24:
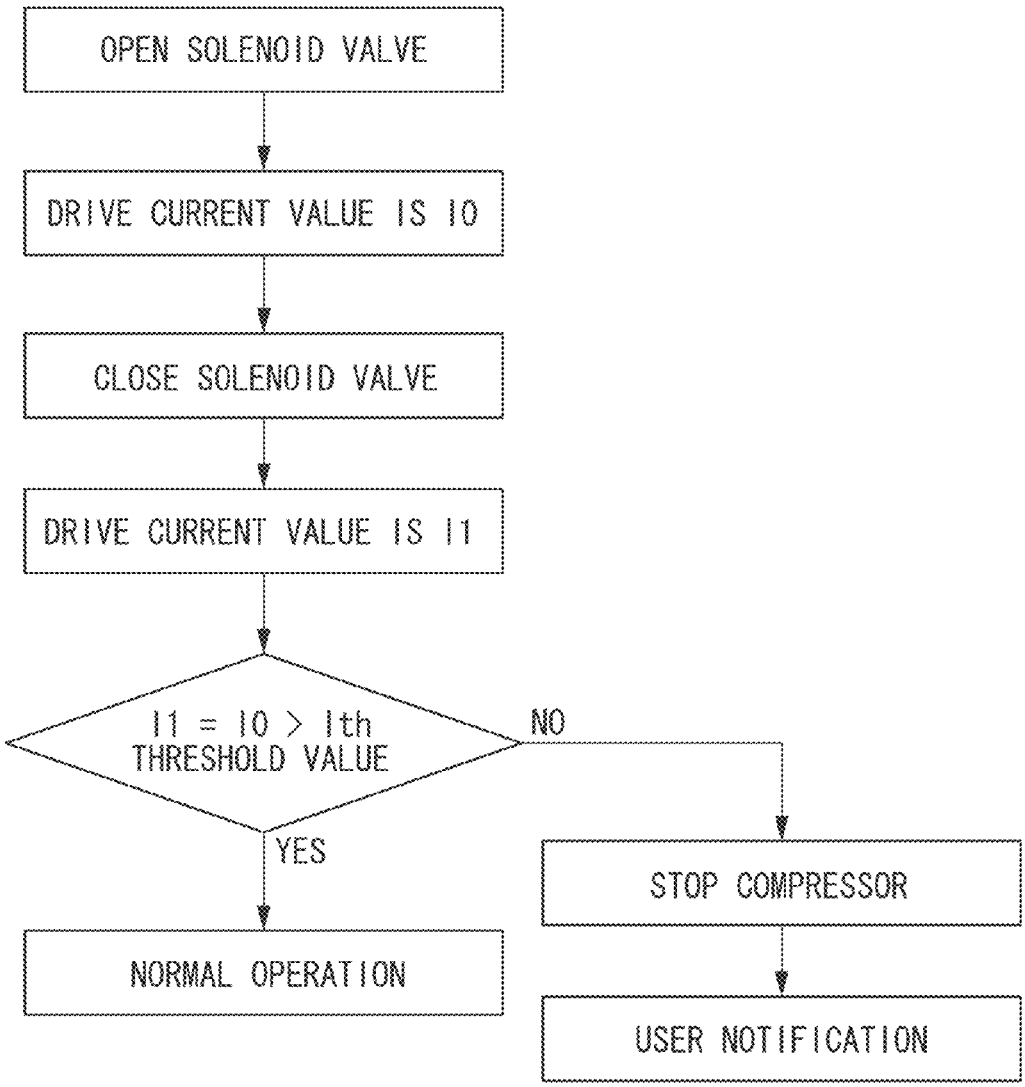
FIG. 24 is another flowchart used for determining whether the solenoid valve is operating normally.

As illustrated in FIG. 24, whether the solenoid valve operates normally can be determined according to a threshold value Ith and drive current values I0 and I1 of the air pump 301 which are changed according to the output pressure of the air pump 301 which varies according to the open/close state of the solenoid valve.

According to a second exemplary embodiment, the failed portion is more precisely detected by using the air open valve connection detection circuit 315 and the output solenoid valve connection detection circuit 317 illustrated in FIG. 7. By using these two circuits, operation failures which can be easily recovered (e.g., disconnection of the connector 502 of the output solenoid valve 304) can be detected. Since the basic configurations of the second exemplary embodiment are similar to those of the first exemplary embodiment, their description is not repeated.

Figure 17:
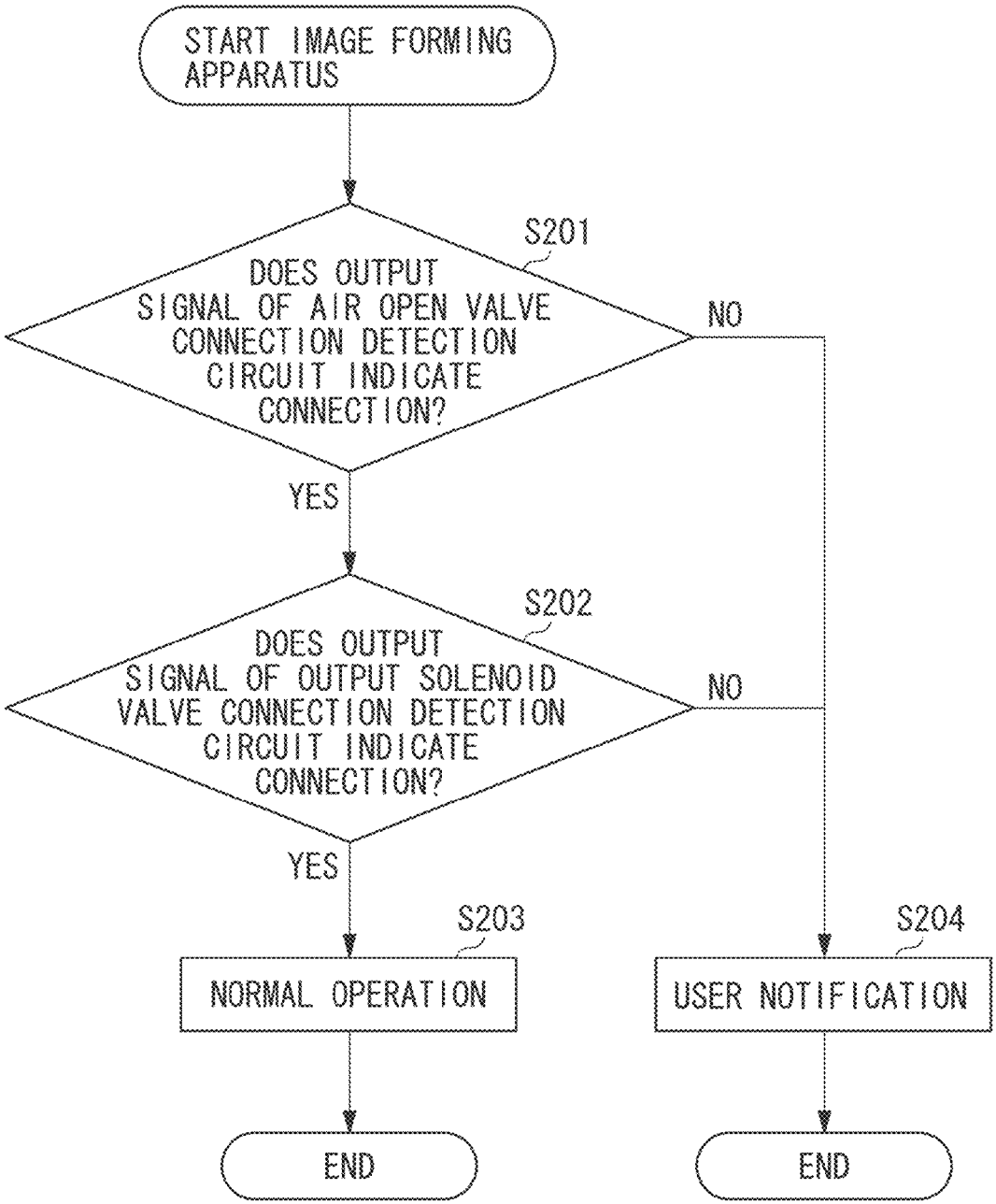
FIG. 17 is a flowchart illustrating the control of the CPU according to a second exemplary embodiment of the present invention.

The operation of the CPU 101 according to the second exemplary embodiment will now be described with reference to the flowchart in FIG. 17. In step S201, the CPU 101 determines whether the air open valve 302 of the air supply mechanism 300 is electrically connected immediately after the image forming apparatus 100 is started based on a detection signal output from the air open valve connection detection circuit 315. If the air open valve 302 is connected (YES in step S201), the processing proceeds to step S202. If the air open valve 302 is disconnected (NO in step S201), the processing proceeds to step S204. In step S202, the CPU 101 determines whether the output solenoid valve 304 of the air supply mechanism 300 is electrically connected based on a detection signal output from the output solenoid valve connection detection circuit 317. If the output solenoid valve 304 is connected (YES in step S202), the processing proceeds to step S203. If the output solenoid valve 304 is disconnected (NO in step S202), the processing proceeds to step S204.

If the CPU 101 determines that both the air open valve 302 and the output solenoid valve 304 are normally connected in steps S201 and S202, in step S203, the CPU 101 performs the normal operation. The normal operation is execution of the job concerned. Further, the normal operation includes the operation including stopping the drive of the air pump 301, executing the preparation operation of the image forming apparatus 100, and finishing the preparation operation.

Figure 18:
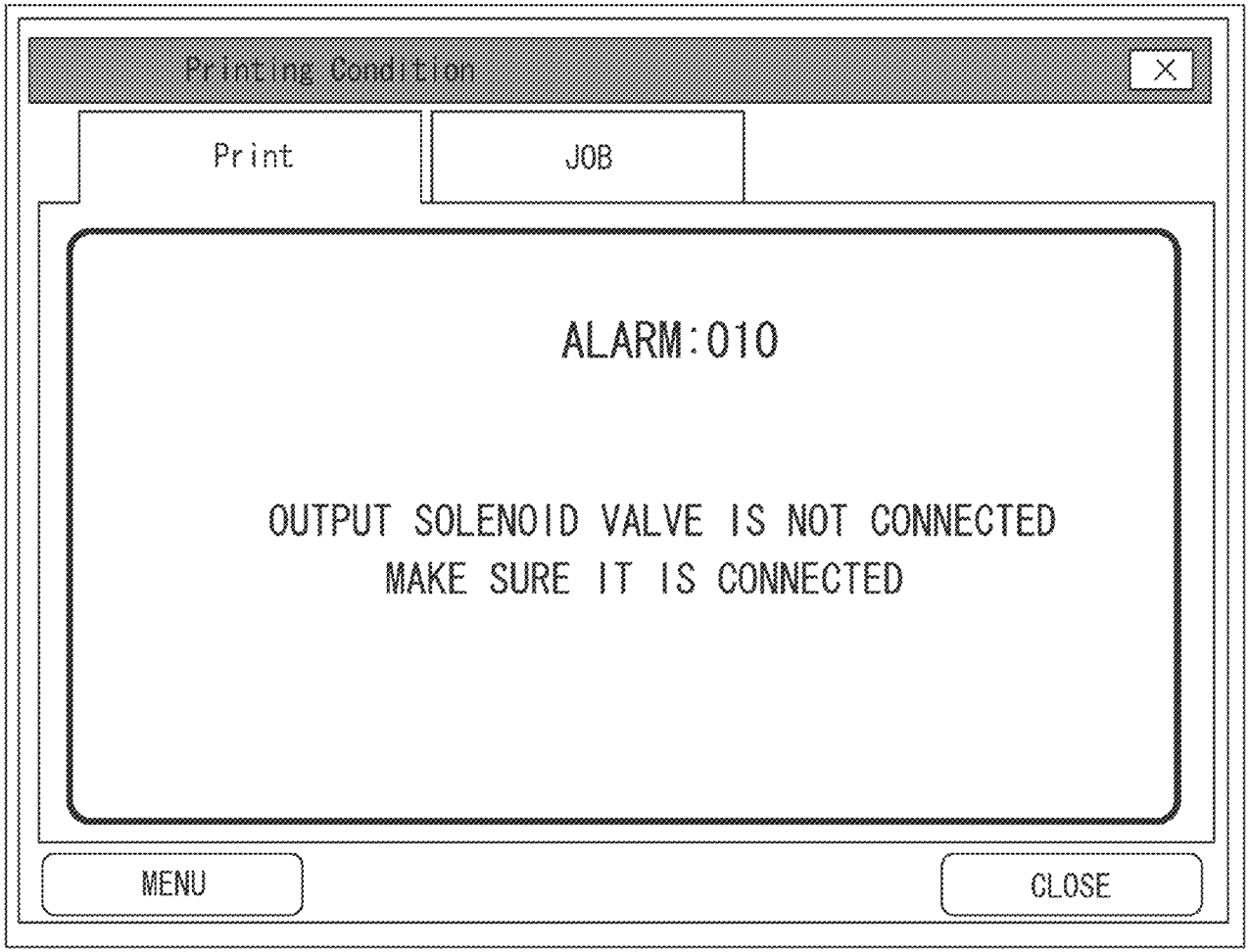
FIG. 18 illustrates a message displayed on the display unit when the connection of the output solenoid valve is not detected.

In steps S201 and S202, if the CPU 101 determines that either or both of the air open valve 302 and the output solenoid valve 304 are disconnected, a message notifying the user of the disconnection is displayed on the information display unit 102*a* of the operation panel unit 102. FIG. 18 illustrates the message which is displayed when the output solenoid valve 304 is detected as disconnected. If the CPU 101 determines that the air open valve 302 is disconnected, a message notifying the user of the disconnection of the air open valve 302 is displayed on the information display unit 102*a*.

According to the present embodiment, although the connection of the output solenoid valve 304 is determined after the determination of the connection of the air open valve 302, this order can be reversed. Further, although the determination of the connection is performed immediately after the start of the image forming apparatus 100, it can be performed at any time before the print job which needs the operation of the air pump 301 is started.

Figure 19:
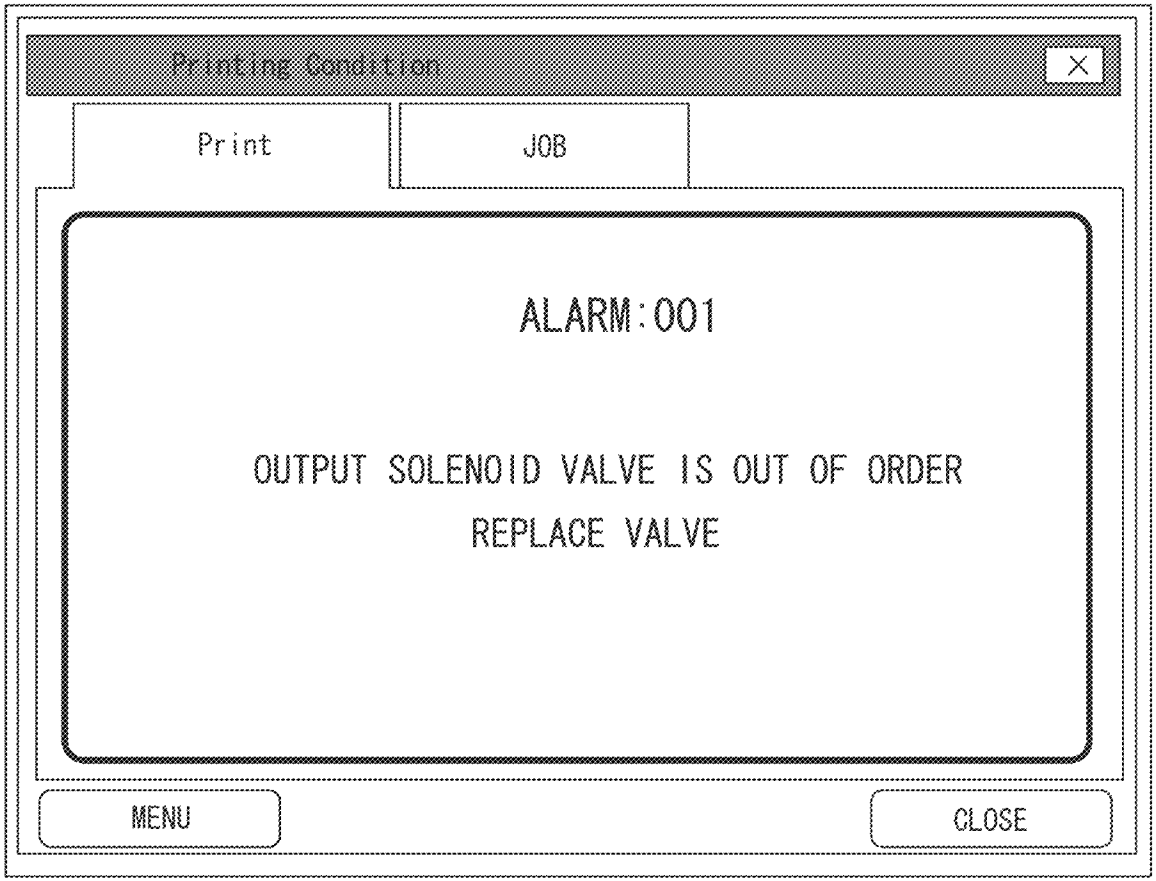
FIG. 19 illustrates a message displayed on the display unit when a failure of the output solenoid valve is determined.

In the sequence above, when both of the air open valve 302 and the output solenoid valve 304 are normally connected, if the CPU 101 determines that the output solenoid valve 304 is not operating normally according to the flowchart in FIG. 15 (V0−V1<Vth in step S107), the CPU 101 displays an alarm message informing the user of the failure of the output solenoid valve 304 on the information display unit 102*a* of the operation panel unit 102. An example of such a message is illustrated in FIG. 19.

In other words, the CPU 101 determines that the output solenoid valve 304 has failed when the output solenoid valve 304 is determined as electrically connected according to the detection of the output solenoid valve connection detection circuit 317 but is also determined as not operating normally.

As described above, the control system of the air supply mechanism 300 includes the output solenoid valve connection detection circuit 317 which detects the electric connection to the CPU 101, of the output solenoid valve 304. The CPU 101 determines that the output solenoid valve 304 has failed when the output solenoid valve 304 is determined as electrically connected by the output solenoid valve connection detection circuit 317 but is also determined as not operating normally. Accordingly, the CPU 101 can determine whether the failed state is due to a signal line disconnection of the connector 501 or 502 or due to the failure of the output solenoid valve 304 itself.

According to the first and the second exemplary embodiments, it is determined whether the output solenoid valve 304 is operating normally. According to a third exemplary embodiment, whether the air pump 301 is not operating or whether the air open valve 302 has failed is detected by the current detection of the air pump 301. Since the basic configurations of the third exemplary embodiment are similar to those of the first exemplary embodiment, their description is not repeated.

Figure 20:
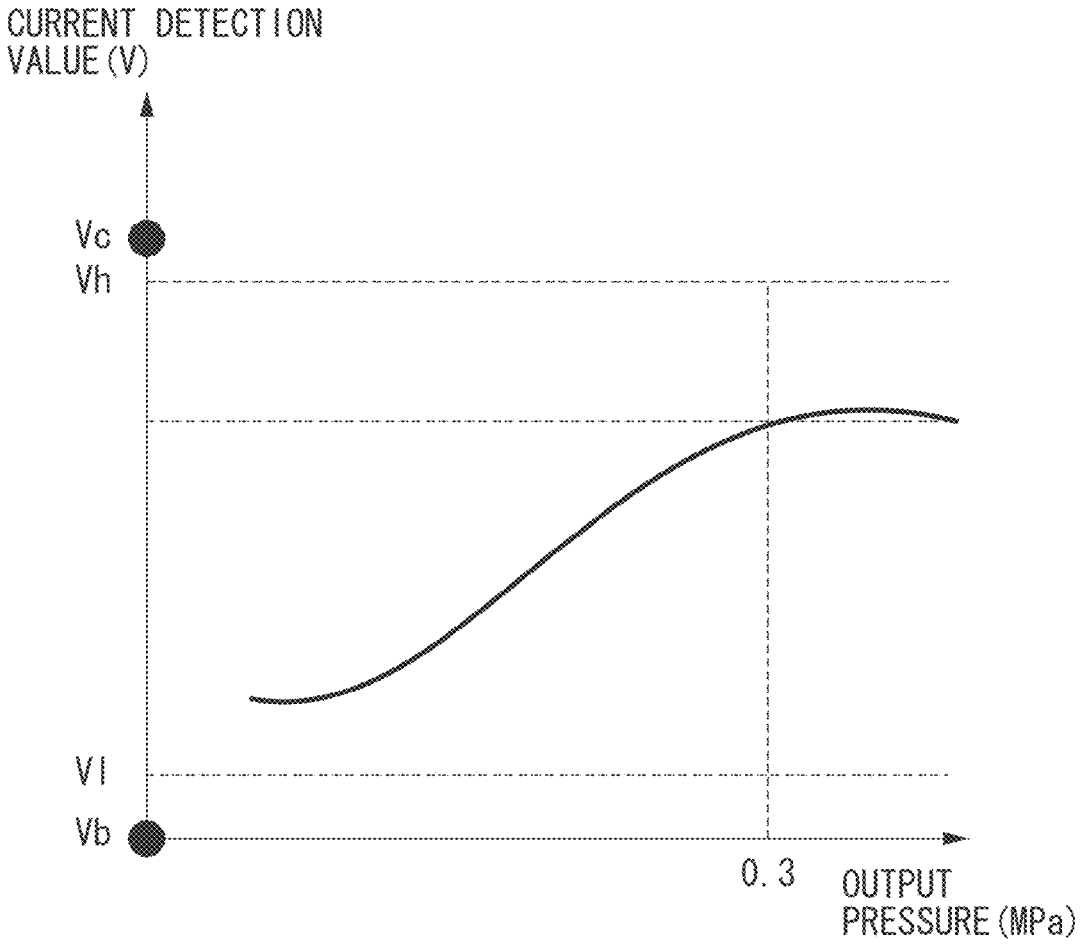
FIG. 20 is a graph illustrating a change in the current detection signal with respect to the output pressure of the air pump according to a third exemplary embodiment of the present invention.

FIG. 20 is a graph illustrating a detection voltage of the current detection signal 610 input into the CPU 101 in association with the graph illustrated in FIG. 12. The detection voltage is obtained by converting the current value of the air pump 301 into the voltage when the air pump is not operating. In the state of the graph illustrated in FIG. 20, the air pump 301 is started and the air open valve 302 is opened by the CPU 101.

A voltage value Vb represents a point where the current value of the air pump 301 is zero. It corresponds to a detection value of the air pump 301 when the alternating current is not supplied to the air pump 301 due to, for example, disconnection of a connector 605 (see FIG. 11) or failure of the relay 601. Further, a voltage value Vc represents a point where the current value of the air pump 301 is sufficiently high compared to the current value of the normal pressure output operation. When the voltage value is Vc, it is considered that the AC motor of the air pump 301 is locked. The cause of the lock may be the failure of the air pump 301 or the air open valve 302 which cannot enter the open state.

Further, a threshold value Vl is slightly higher than the voltage value Vb and a threshold value Vl is slightly lower than the voltage value Vc. The CPU 101 determines that the air pump 301 is operating normally when the level of the current detection signal 610 of the air pump 301 is equal to or greater than Vl and equal to or less than Vh in a case where the air open valve 302 is open.

Figure 21:
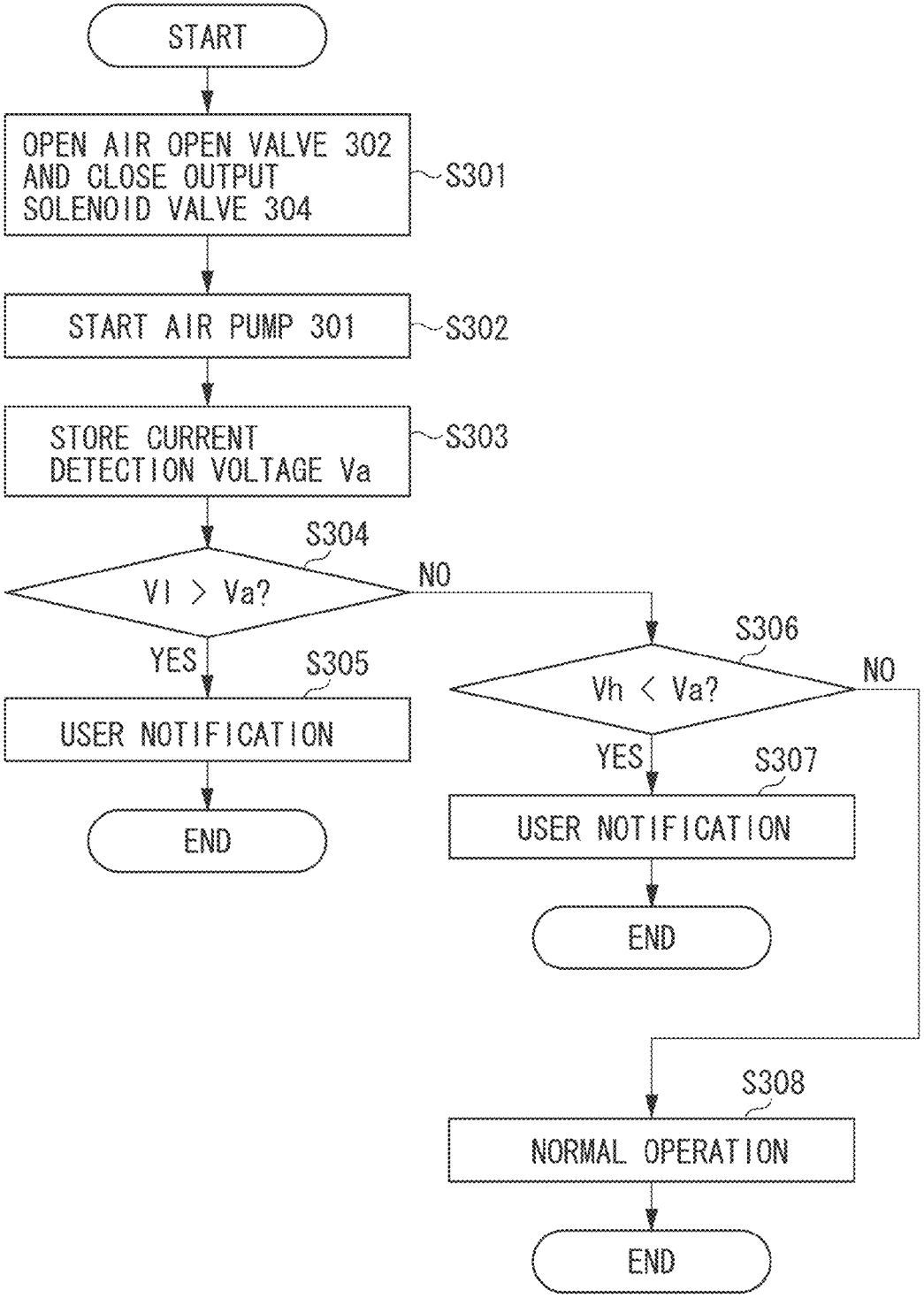
FIG. 21 is a flowchart illustrating the control of the CPU according to the third exemplary embodiment.

The above-described operation will be described with reference to the flowchart in FIG. 21. In step S301, the CPU 101 outputs a command for causing the air open valve 302 to open and also outputs a command for causing the output solenoid valve 304 to close. In step S302, the CPU 101 starts the air pump 301. In step S303, the CPU 101 stores the detection value of the current detection signal 610 at the time the air pump 301 has been started, in the memory M (RAM M in FIG. 9) as Va.

Figure 22:
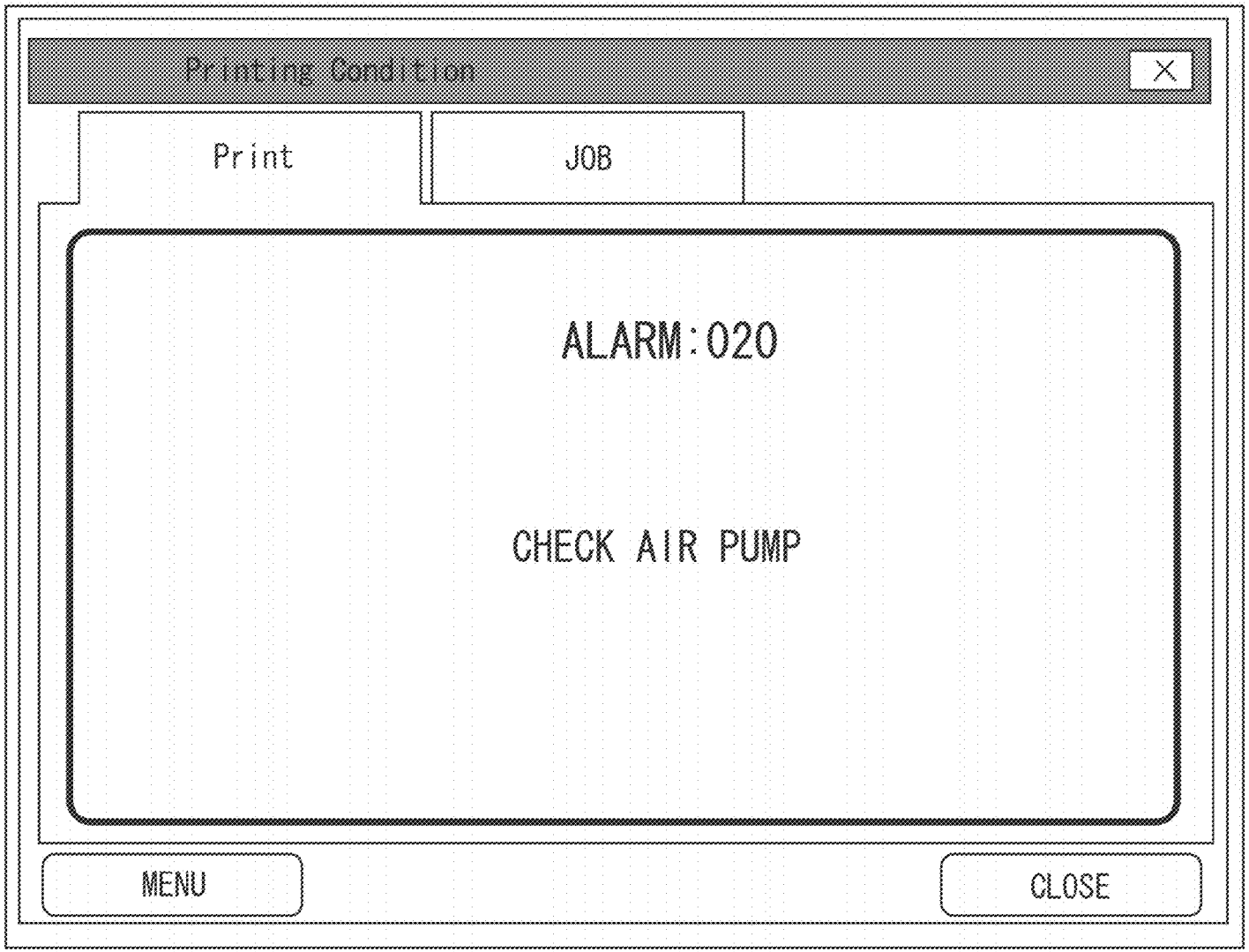
FIG. 22 illustrates a message displayed on the display unit when the detected current value of the air pump when the air is released is low.

Subsequently, the CPU 101 determines whether Vl<Va<Vh. In step S304, the CPU 101 determines whether Vl>Va. If Vl≥Va (YES in step S304), the processing proceeds to step S305. If Vl<Va (NO in step S304), the processing proceeds to step S306. In step S305, since the air pump 301 may have failed, the CPU 101 displays a message, such as the one illustrated in FIG. 22, on the information display unit 102*a* of the operation panel unit 102.

The air supply mechanism 300 includes the air open valve 302 configured to release the internal pressure of the relief valve 303 when the air pump 301 is started so that the internal pressure is in equilibrium with the atmosphere. The air open valve 302 is provided in the connection air conduit 320 between the air pump 301 and the output solenoid valve 304. The CPU 101 determines whether the air pump 301 has failed according to the current value detected by the air pump current detection circuit 313 when the air open valve 302 is opened.

Figure 23:
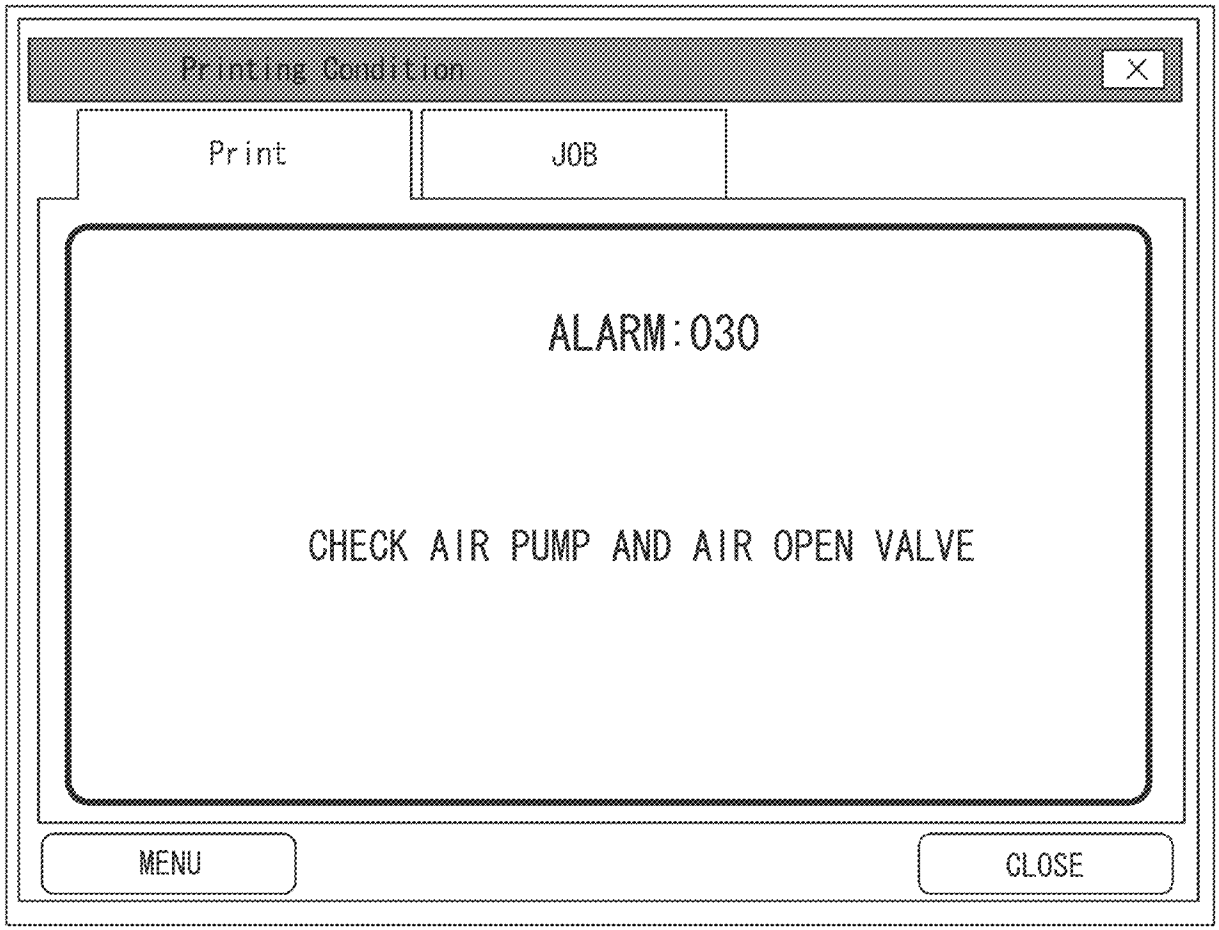
FIG. 23 illustrates a message displayed on the display unit when the detected current value of the air pump when the air is released is high.

If Vl<Va, in step S306, the CPU 101 determines whether Va>Vh. If Va>Vh (YES in step S306), the processing proceeds to step S307. In step S307, since the air pump 301 or the air open valve 302 may have failed, the CPU 101 displays a message, such as the one illustrated in FIG. 23, on the information display unit 102*a* of the operation panel unit 102. Further, if not Va>Vh (NO in step S306), the processing proceeds to step S308. In step S308, the CPU 101 performs the normal operation.

The control of the CPU 101 according to the first to the third exemplary embodiments is summarized as follows. The CPU 101 is a determination unit configured to determine whether the air open valve 302 and the output solenoid valve 304 (valve units) are in an abnormal state. The air open valve 302 and the output solenoid valve 304 are configured to control the supply of air compressed by the air pump 301 to the nozzle mechanism 40 (air blowing portion) corresponding to the output of the air pump current detection circuit 313 (current detector) which detects the drive current of the air pump 301. The CPU 101 determines whether the air pump 301 (pump), the air open valve 302, or the output solenoid valve 304 is in an abnormal state according to the output of the air pump current detection circuit 313.

When the air supply mechanism 300 is under a predetermined pressure exerted by the air pump 301, the CPU 101 determines whether abnormality exists in the air open valve 302 and the output solenoid valve 304 according to the output of the air pump current detection circuit 313 when the air open valve 302 or the output solenoid valve 304 is opened/closed. The air open valve connection detection circuit 315 and the output solenoid valve connection detection circuit 317 detect the connected state of the air open valve 302 and the output solenoid valve 304, respectively. The CPU 101 determines whether the abnormality of the air open valve 302 and the output solenoid valve 304 exists according to the output of the air open valve connection detection circuit 315, the output solenoid valve connection detection circuit 317, and the air pump current detection circuit 313. The CPU 101 determines whether the air pump 301 is in an abnormal state according to the output of the air pump current detection circuit 313 when the air open valve 302 and the output solenoid valve 304 are closed.

The air supply mechanism 300 further includes the connection air conduit 320 configured to connect the air pump 301, the air open valve 302, and the output solenoid valve 304 as well as the air open valve 302 configured to release the pressure so that the internal pressure of the connection air conduit 320 is in equilibrium with the atmosphere. The CPU 101 determines whether the air pump 301 is in an abnormal state according to the output of the air pump current detection circuit 313 when the output solenoid valve 304 is closed and the air open valve 302 is open. Further, the image forming apparatus 100 is connected to the operation panel unit 102 (notification unit) and the information display unit 102*a* which are used for notifying the user of the abnormality of the air open valve 302, the output solenoid valve 304, or the air pump 301 when such an abnormality is determined by the CPU 101.

The CPU10 is an inhibition portion configured to inhibit the fixing processing when the air open valve 302, the output solenoid valve 304, or the air pump 301 is determined to be in the abnormal state. When the air open valve 302 or the output solenoid valve 304 is closed, the CPU 101 determines whether the pump unit 301 is in the abnormal state according to the output of the air pump current detection circuit 313.

[Other Matters]

(1) The gas which is compressed and jetted is not limited to air. It can be a gas other than air such as a nitrogen gas or a carbon dioxide gas.

(2) The air blowing mechanism and the air supply mechanism used for separating the sheet P from the heating roller 31 can be applied to the second fixing unit F2 similar to the first fixing unit F1.

(3) Although a case where the sheet P is separated from the heating roller 31 of the first fixing unit F1 is described in the above-described exemplary embodiments, the present invention is not limited to such an example. For example, the air blowing mechanism and the air supply mechanism, such as those described in the first to the third exemplary embodiments, can be applied to the pressure application belt 32 of the first fixing unit F1 or the pressure roller 39 of the second fixing unit F2 serving as the first rotating member.

(4) According to the above-described exemplary embodiments, the fixing unit is described as a unit configured to heat and fix the unfixed toner image t onto the sheet P as a fixed image. However, the fixing unit of the present invention is not limited to such an example. For example, a unit configured to fix a temporary-fixed toner image onto the sheet P for the purpose of enhancing gloss of the image by heat and pressure application (also in this case referred to as a fixing unit) such as the second fixing unit F2 is also included in the fixing unit.

(5) The rotatable heating member configured to apply heat to the image on the recording material is not limited to a roller member. For example, it can be a cylindrical belt member having flexibility or an endless belt having flexibility and stretched and supported by a plurality of members.

(6) The pressure application rotating member configured to form the nip portion with the rotatable heating member is not limited to a roller member either and can be a belt member.

(7) The image forming apparatus of the present invention can be an image forming apparatus other than the electrophotography full-color printer according to the exemplary embodiments. In other words, the image forming apparatus can be a monochromatic copier, a facsimile machine, a monochromatic printer, or a multifunction peripheral. The image forming method of the image forming apparatus is not limited to the electrophotographic method. For example, it can be the electrostatic recording method or the magnetic recording method. Further, a different type of transfer method can be used for forming the unfixed image on the recording material. For example, the unfixed image can be formed by the direct method. Further, the image forming apparatus can be an ink jet printer or a sublimation printer. In other words, the image forming apparatus is an apparatus that forms an image on a recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-086374 filed Apr. 17, 2013, which is hereby incorporated by reference herein in its entirety.

What is claimed is:

1. A fixing unit comprising:

a first rotating member and a second rotating member configured to form a nip portion used for fixing a toner image onto a sheet;

an air blowing portion configured to blow air to separate the sheet from the first rotating member;

a pump portion connected to the air blowing portion;

a valve portion configured to supply or not supply air compressed by the pump portion to the air blowing portion;

a current detection portion configured to detect a drive current of the pump portion when the air is compressed; and a determination portion configured to determine whether an abnormality of the valve portion exists, according to an output of the current detection portion.

2. The fixing portion according to claim 1, wherein the determination portion determines whether the abnormality of the valve portion exists, according to the output of the current detection portion obtained when a command for causing the valve portion to open is output, and the output of the current detection portion obtained when a command for causing the valve portion to close is output.

3. The fixing portion according to claim 1, further comprising a connection detection portion configured to detect connection to the valve portion, wherein the determination portion determines whether the abnormality of the valve portion exists, according to an output of the connection detection portion and the output of the current detection portion.

4. The fixing portion according to claim 1, wherein the determination portion determines which of the pump portion and the valve portion is abnormal, according to the output of the current detection portion.

5. The fixing portion according to claim 4, wherein the determination portion determines whether the abnormality of the pump portion exists, according to the output of the current detection portion obtained when a command for causing the valve portion to close is output.

6. The fixing portion according to claim 4, further comprising a connection conduit configured to connect the pump portion and the valve portion, and an air open valve portion configured to release pressure in the conduit of the connection conduit such that the pressure is in equilibrium with atmosphere, wherein the determination portion determines whether the abnormality of the pump portion exists, according to the output of the current detection portion obtained when a command for causing the valve portion to close is output and a command for causing the air open valve portion to open is output.

7. The fixing portion according to claim 4, further comprising a notification portion configured to perform notification when the determination portion determines that the valve portion or the pump portion is abnormal.

8. The fixing portion according to claim 4, further comprising an inhibition portion configured to inhibit fixing processing when the determination portion determines that the valve portion or the pump portion is abnormal.

9. The fixing portion according to claim 8, wherein if the determination portion determines that the valve portion or the pump portion is abnormal, the inhibition portion inhibits the fixing processing of a sheet of a grammage equal to or less than a predetermined value as well as permits the fixing processing of a sheet of a grammage greater than the predetermined grammage.

10. The fixing portion according to claim 1, wherein the connection conduit includes an adjustment portion configured to adjust a pressure in the conduit to a predetermined pressure.

11. The fixing portion according to claim 1, further comprising a notification portion configured to perform notification when the determination portion determines that the valve portion is abnormal.

12. The fixing portion according to claim 1, further comprising an inhibition portion configured to inhibit fixing processing when the determination portion determines that the valve portion is abnormal.

13. The fixing portion according to claim 12, wherein if the determination portion determines that the valve portion is abnormal, the inhibition portion inhibits the fixing processing of a sheet of a grammage equal to or less than a predetermined value as well as permits the fixing processing of a sheet of a grammage greater than a predetermined grammage.

14. The fixing portion according to claim 1, wherein the air blowing portion includes a tubular portion extending in a longitudinal direction of the first rotating member, wherein the tubular portion includes a plurality of apertures formed to allow passage of the air at different positions in the longitudinal direction.

15. The fixing portion according to claim 1, wherein the first rotating member is arranged on a side contacting the toner image on the sheet, at the nip portion.

16. The fixing portion according to claim 1, wherein the second rotating member is arranged on an opposite side of the side contacting the toner image on the sheet, at the nip portion.

* * * * *